US007008199B2

(12) United States Patent
Matsumoto et al.

(10) Patent No.: US 7,008,199 B2
(45) Date of Patent: Mar. 7, 2006

(54) ROTARY COMPRESSOR, METHOD FOR MANUFACTURING THE SAME, AND DEFROSTER FOR REFRIGERANT CIRCUIT

(75) Inventors: Kenzo Matsumoto, Gunma (JP); Haruhisa Yamasaki, Gunma (JP); Masaya Tadano, Gunma (JP); Kazuya Sato, Gunma (JP); Dai Matsuura, Gunma (JP); Takayasu Saito, Gunma (JP); Noriyuki Tsuda, Ora-Gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 40 days.

(21) Appl. No.: 10/916,273

(22) Filed: Aug. 11, 2004

(65) Prior Publication Data

US 2005/0008518 A1 Jan. 13, 2005

Related U.S. Application Data

(62) Division of application No. 10/305,775, filed on Nov. 27, 2002.

(30) Foreign Application Priority Data

| | | |
|---|---|---|
| Nov. 30, 2001 | (JP) | 2001-366209 |
| Nov. 30, 2001 | (JP) | 2001-366210 |
| Dec. 7, 2001 | (JP) | 2001-374296 |
| Jan. 24, 2002 | (JP) | 2002-015350 |
| Jan. 30, 2002 | (JP) | 2002-021338 |
| Feb. 6, 2002 | (JP) | 2002-028857 |

(51) Int. Cl.
*F03C 2/00* (2006.01)
*F04C 2/00* (2006.01)

(52) U.S. Cl. ..... 418/60; 418/11; 418/31; 418/66

(58) Field of Classification Search ..... 418/60, 418/63, 11, 16, 31, 66
See application file for complete search history.

(56) References Cited

U.S. PATENT DOCUMENTS

| | | | | |
|---|---|---|---|---|
| 3,130,902 A * | 4/1964 | Brown | 418/63 |
| 4,726,739 A * | 2/1988 | Saitou et al. | 418/60 |
| 4,975,031 A * | 12/1990 | Bagepalli et al. | 418/63 |
| 5,242,280 A * | 9/1993 | Fujio | 418/11 |
| 5,322,424 A * | 6/1994 | Fujio | 418/11 |
| 5,580,231 A * | 12/1996 | Yasui | 418/66 |
| 6,270,329 B1 * | 8/2001 | Oshima et al. | 418/63 |
| 6,336,336 B1 * | 1/2002 | Kawaminami et al. | 62/196.3 |
| 6,592,347 B1 * | 7/2003 | Matsumoto et al. | 418/63 |

* cited by examiner

*Primary Examiner*—Theresa Trieu
(74) *Attorney, Agent, or Firm*—Darby & Darby

(57) ABSTRACT

An object of the present invention is to provide a method for manufacturing a multi-stage compression type rotary compressor which can avoid the replacement of parts to be used as much as possible to reduce costs and also which enables easily setting an appropriate displacement volume ratio while preventing the compressor from being increased in size. The gist of the present invention is that an inner diameter of a lower cylinder is altered without altering its thickness (or height), and a displacement volume ratio between first and second rotary compression elements is set to an optimum value in accordance with the alteration.

3 Claims, 19 Drawing Sheets

ROTARY COMPRESSOR, METHOD FOR MANUFACTURING THE SAME, AND DEFROSTER FOR REFRIGERANT CIRCUIT

This application is a division of application Ser. No. 10/305,775, filed Nov. 27, 2002.

BACKGROUND OF THE INVENTION

1. Field of the Invention

The present invention relates to a rotary compressor which compresses a refrigerant by a rotary compression element to discharge it, a method for manufacturing the same, and a defroster for a refrigerant circuit using the same.

2. Description of the Related Art

Conventionally, in a multi-stage compression type rotary compressor, a refrigerant gas is sucked through a suction port of a first rotary compression element into a low-pressure chamber side of a cylinder, compressed by the operations of a roller and a vane to have a medium pressure, and discharged into a sealed vessel through a discharge port of the side of a high pressure chamber of the cylinder. Then, the refrigerant gas having the medium pressure in the sealed vessel is sucked through a suction port of a second rotary compression element into the low-pressure chamber side of the cylinder, undergoes second-stage compression through the operations of the roller and the vane to have a high temperature and a high pressure, and is discharged from the discharge port of the high-pressure chamber side. The refrigerant thus discharged from this compressor flows into a radiator to radiate its heat, is squeezed by an expansion valve to absorb heat at an evaporator, and sucked into the first rotary compression element, which cycle is repeated.

In such a multi-stage compression type rotary compressor, especially when, for example, carbon dioxide ($CO_2$) having a large difference between the high and low pressures is used as the refrigerant, as shown in FIG. 5, a pressure of the discharged refrigerant reaches 12 MPaG in the second rotary compression element where the refrigerant has the high pressure (HP) and becomes 8 MPaG (medium pressure: MP) in the first rotary compression element which is the lower-stage side (where a suction pressure LP of the first rotary compression element is 4 MPaG). As a result, a differential pressure at the second stage (difference between the suction pressure MP of the second rotary compression element and the discharge pressure HP of the second rotary compression element) becomes a large value of 4 MPaG. Especially when an outside air temperature is low, the discharge pressure MP of the first rotary compression element becomes lower and, therefore, the second-stage differential pressure (difference between the suction pressure MP of the second rotary compression element and the discharge pressure HP of the second rotary compression element) increases further, so that a compression load of the second rotary compression element increases to bring about a problem that durability and reliability deteriorate.

Therefore, conventionally, by altering a dimension of thickness (or height) of the cylinder of the first rotary compression element so that a displacement volume of the second rotary compression element may be smaller than that of the first rotary compression element, a displacement volume ratio has been set so as to reduce a differential pressure at a second stage.

By such a setting method, however, the thickness (or height) of the first cylinder becomes large, so that correspondingly all of a cylinder material and the roller of the first rotary compression element, an eccentric portion, etc. have had to be replaced. Furthermore, as the thickness (or height) of the cylinder increases, the thickness (or height) of a rotary compression-mechanism also increases, so that overall size of the relevant multi-stage compression type rotary compressor becomes larger, thus bringing about a problem of a difficulty in miniaturization of the compressor.

It is to be noted that the vane attached to such a multi-stage compression type rotary compressor is inserted movably in a groove formed in a radial direction of the cylinder. Such a vane is pressed against the roller to divide an inside of the cylinder into a low-pressure chamber side and a high-pressure chamber side in such a configuration that on a rear side of the vane a spring is provided to urge this vane on a roller side and also in the groove a back pressure chamber is provided which communicates with the high-pressure chamber of the cylinder to urge this vane on the roller side.

It is to be noted that in an internal medium-pressure type rotary compressor a pressure is higher in the cylinder of the second rotary compression element than in the sealed vessel, so that a pressure on a refrigerant discharge side of the second rotary compression element is applied to the back pressure chamber which urges the vane of this second rotary compression element.

If, for example, carbon dioxide ($CO_2$) having a large difference between high and low pressures is used as the refrigerant, however, as shown in FIG. 5, a discharged refrigerant pressure reaches 12 MPaG in the second rotary compression element where it has the high pressure (HP). Accordingly, when a pressure on the refrigerant discharge side of the second rotary compression element is applied to the back pressure chamber, a pressure to press the vane against the roller becomes higher than necessary to thereby apply a large load on a portion where a tip of the vane slides along an outer periphery of the roller, thus bringing about a problem that the vane and the roller may be worn heavily or, in the worst case, be damaged.

Furthermore, a discharge-noise silencer chamber of each of the first and second rotary compression elements is provided with a discharge valve to prevent back-flow of the refrigerant when it is discharged into the discharge-noise silencer chamber, using which discharge valve the discharge port can be opened and closed when necessary.

It is to be noted that if, for example, carbon dioxide ($CO_2$) having a large difference between high and low pressures is used as the refrigerant, as shown in FIG. 5, the discharged refrigerant pressure reaches 12 MPaG at the second rotary compression element where it has the high pressure (HP) and, on the other hand, becomes 8 MPaG (medium pressure: MP) at the first rotary compression element which is a lower-stage side at an outside air temperature of 15° C. (where the suction pressure LP of the first rotary compression element is 4 MPaG). As a result, a differential pressure at the first stage (difference between the suction pressure LP of the first rotary compression element and the discharge pressure MP of the first rotary compression element) becomes a large value of 4 MPaG. Moreover, with an increasing temperature of an outside air, the discharge pressure MP of the first rotary compression element increases rapidly, so that the first-stage differential pressure (difference between the suction pressure LP of the first rotary compression element and the discharge pressure MP of the first rotary compression element) increases further.

When the first-stage differential pressure increases in such a manner, a pressure difference between an inside and an outside of the discharge valve which opens and closes the discharge port of the first rotary compression element becomes excess, thus bringing about a problem of deterioration in durability and reliability such as damages of the discharge valve.

If the outside air temperature drops to reduce an evaporation temperature of the refrigerant, the discharge pressure MP of the first rotary compression element decreases, so that the second-stage differential pressure (difference between the suction pressure MP of the second rotary compression element and the discharge pressure HP of the second rotary compression element) increases further.

When the second-stage differential pressure increases in such a manner, a pressure difference between an inside and an outside of the discharge valve of the second rotary compression element becomes excess, thus bringing about a problem that the discharge valve etc. of the second rotary compression element may be damaged by this pressure difference.

Furthermore, the vane used in the rotary compressor is inserted movably in a guide groove provided in a radial direction of the cylinder. This vane, however, needs to be pressed toward the roller side always, so that conventionally, in configuration, the vane has been urged on the roller side not only by a spring but also by a back pressure applied to a back pressure chamber formed in the cylinder beforehand, thus complicating a construction.

Especially at the second rotary compression element of such an internal medium-pressure, multi-stage compression type rotary compressor, a pressure in the cylinder is higher than the medium pressure in the sealed vessel, thus bringing about a problem that a communication path needs to be formed through which a high back pressure is applied to the back pressure chamber.

Furthermore, in a refrigerant circuit using such a multi-stage compression type rotary compressor, an evaporator is liable to be frosted and so needs to be defrosted; however, if, to defrost this evaporator, a high-temperature refrigerant discharged from the second rotary compression element is supplied to the evaporator without being decompressed at a decompression device (in both cases of being directly supplied to the evaporator and being supplied thereto only by being passed through the decompression device but not being decompressed therethrough), the suction pressure of the first rotary compression element rises to thereby increase the discharge pressure (medium pressure) of the first rotary compression element. Thus, when this refrigerant is discharged through the second rotary compression element, it is not decompressed, so that the discharge pressure of the second rotary compression element becomes almost the same as the suction pressure of the first rotary compression element, thus bringing about a problem that a pressure level relationship may be reversed when the refrigerant is discharged from or sucked into the second rotary compression element.

This reversion in pressure level relationship during discharge and suction at the second rotary compression element can be avoided by providing such a refrigerator circuit as to supply the evaporator with a refrigerant discharged from the first rotary compression element without decompressing it so that the evaporator can be defrosted by supplying, using this refrigerant circuit, it with also the refrigerant discharged from the rotary compression element.

In this case, however, a discharge side of the first rotary compression element and that of the second rotary compression element communicate to each other in construction, so that a same pressure appears on the suction side and the discharge side of the second rotary compression element, thus bringing about a problem of unstable operation of the second rotary compression element such as breakaway of the vane from the second rotary compression element.

SUMMARY OF THE INVENTION

To solve those problems of the conventional technologies, the present invention has been developed, and it is an object of the present invention to provide a method for manufacturing a multi-stage compression type rotary compressor which can avoid the replacement of parts to be used as much as possible to reduce costs and also which enables easily setting an appropriate displacement volume ratio while preventing the compressor from being increased in size.

That is, a multi-stage compression type rotary compressor manufacturing method according to the present invention is directed to a method for manufacturing a multi-stage compression type rotary compressor which comprises an electrical-power element and first and second rotary compression elements driven by the electrical-power element in a sealed vessel and in which these first and second rotary compression elements are constituted of first and second cylinders and first and second rollers which are fitted to first and second eccentric portions formed on a rotary shaft of the electrical-power element so as to eccentrically revolves in these cylinders; and a refrigerant gas compressed in the first rotary compression element and discharged therefrom is sucked into the second rotary compression element, compressed and then discharged therefrom; wherein an inner diameter of the first cylinder is altered without altering its thickness (or height); and a displacement volume ratio between the first and second rotary compression elements is set in accordance with the alteration.

By the present invention, therefore, costs can be reduced without replacing all of the cylinder material and the roller of the first rotary compression element, the eccentric portion of the rotary shaft, etc. as much as possible, for example, by replacing only the roller or only the roller and the eccentric portion. Furthermore, it is possible to prevent an increase in overall size of the compressor, thus reducing dimensions thereof.

Furthermore, to satisfy the above-mentioned object, the multi-stage compression type rotary compressor manufacturing method according to the present invention sets a displacement volume of the second rotary compression element to not less than 40% and not more than 75% of that of the first rotary compression element.

By thus setting the displacement volume of the second rotary compression element at a value between 40% and 75%, both inclusive, of that of the first rotary compression element, a displacement volume ratio between the first and second rotary compression elements can be set optimally.

It is another object of the present invention to improve durability of a vane and a roller in an internal medium-pressure, multi-stage compression type rotary compressor, thus avoiding damages of the vane and the roller beforehand.

That is, in a multi-stage compression type rotary compressor according to the present invention comprising an electrical-power element and first and second rotary compression elements driven by this electrical-power element in a sealed vessel in such a configuration that a refrigerant gas compressed at the first rotary compression element is discharged into the sealed vessel and this discharged medium pressure refrigerant gas is compressed at the second rotary compression element, wherein there are provided a cylinder constituting the second rotary compression element, a roller which is fitted to an eccentric portion formed on a rotary shaft of the electrical-power element to eccentrically revolve in the cylinder, a vane which butts against this roller to divide an inside of the cylinder into a low-pressure chamber side and a high-pressure chamber side, a back pressure chamber for urging this vane on a roller side always, a communication path which communicates a refrigerant discharge side of the second rotary compression element and the back pressure chamber to each other, and a pressure adjustment valve for adjusting a pressure applied to the back pressure chamber through this communication path, so that by using this pressure adjustment valve, force for pressing the vane against the roller can be held appropriately. Furthermore, by holding a pressure of the back pressure chamber at a predetermined value which is lower than a pressure on a refrigerant discharge side of the second rotary compression element and higher than a pressure in the sealed vessel, it is possible to prevent a back pressure higher than necessary from being applied to the vane while preventing a so-called vane breakaway, thus optimizing force for urging the vane toward the roller.

Accordingly, it is possible to reduce a load applied to a portion where a tip of the vane slides along an outer periphery of the roller to thereby avoid damages of the vane and the roller beforehand, thus improving durability thereof.

Furthermore, by the present invention, in addition to this configuration, there are provided a support member which blocks an opening face of the cylinder and also which has a bearing for the rotary shaft of the electrical-power element and a discharge-noise silencer chamber arranged in this support member in such a configuration that the communication path is formed in the support member to communicate the discharge-noise silencer chamber and the back pressure chamber to each other and also the pressure adjustment valve is provided in the support member, so that it is possible to adjust a pressure in the back pressure chamber of the vane without complicating a construction while effectively utilizing an internal limited space of the sealed vessel. Furthermore, since the communication path and the pressure adjustment valve can be provided in the support member beforehand, a work efficiency in assembly can be improved.

It is a further object of the present invention to provide a multi-stage compression type rotary compressor which can avoid beforehand such deterioration in durability and reliability as to be caused by an excessive first-stage differential pressure.

That is, in a multi-stage compression type rotary compressor according to the present invention comprising an electrical-power element and first and second rotary compression elements driven by this electrical-power element in a sealed vessel in such a configuration that a refrigerant gas compressed in the first rotary compression element and discharged therefrom is sucked into the second rotary compression element to be compressed and discharged therefrom, there are provided a communication path which communicates a refrigerant suction side and a refrigerant discharge side of the first rotary compression element to each other and a valve device which opens and closes this communication path in such a manner as to open it if a pressure difference between the refrigerant suction side and the refrigerant discharge side of the first rotary compression element exceeds a predetermined upper limit value, so that it is possible to suppress the pressure difference between the refrigerant suction side and the refrigerant discharge side of the first rotary compression element, which is the first-stage differential pressure, down to the predetermined upper limit value or less. Accordingly, it is possible to avoid a trouble such as damaging of the discharge valve provided on the first rotary compression element caused by an excessive value of the first-stage differential pressure, thus improving durability and reliability of the rotary compressor.

Furthermore, by the present invention, there are also provided a cylinder constituting the first rotary compression element, a support member which blocks an opening face of this cylinder and which has a bearing for the rotary shaft of the electrical-power element, and a suction path and a discharge-noise silencer chamber which are arranged in this support member in such a configuration that the communication path is formed in the support member to communicate the suction path and the discharge-noise silencer chamber to each other and also the valve device is provided in the support member, so that the communication path and the valve device can be integrated into the cylinder of the first rotary compression element to realize miniaturization and also the valve device can be set into the cylinder beforehand, thus improving a work efficiency in assembly.

It is a still further object of the present invention to provide a multi-stage compression type rotary compressor which can avoid beforehand a damage and a trouble of the discharge valve etc. of the second rotary compression element caused by a second-stage differential pressure.

That is, a multi-stage compression type rotary compressor according to the present invention comprises an electrical-power element and first and second rotary compression elements driven by this electrical-power element in a sealed vessel so as to suck a medium pressure refrigerant gas compressed in the first rotary compression element into the second rotary compression element and then compress and discharge it therefrom, wherein there are provided a communication path which communicates a passage through which the medium pressure refrigerant gas passes as compressed at the first rotary compression element and a refrigerant discharge side of the second rotary compression element to each other and a valve device which opens and closes this communication path in such a manner as to open it if a pressure difference between the medium pressure refrigerant gas and the refrigerant gas on a refrigerant discharge side of the second rotary compression element exceeds a predetermined upper limit value, so that it is possible to suppress a pressure difference between a discharge pressure and a suction pressure of the second rotary compression element, that is, a second-sage differential pressure, down to the predetermined upper limit value or less.

Accordingly, it is possible to avoid an occurrence of a trouble such as damaging of the discharge valve of the second rotary compression element.

Furthermore, by the present invention, in addition to this configuration, there are provided a cylinder which constitutes the second rotary compression element and a discharge-noise silencer chamber which discharges a refrigerant gas compressed in this cylinder in such a configuration that a medium pressure refrigerant gas compressed at the first rotary compression element is discharged into the sealed vessel and then sucked into the second rotary compression element, the communication path is formed in a wall defining the discharge-noise silencer chamber to communicate an inside of the sealed vessel and the discharge-noise silencer chamber, and the valve device is provided in the wall, so that it is possible to integrate the communication path which communicates the passage for the medium pressure refrigerant compressed at the first rotary compression element and the refrigerant discharge side of the second rotary compression element to each other and the valve device which opens and closes the communication path into a wall of the second rotary compression element.

Accordingly, it is possible to simplify a construction and reduce overall size.

It is an additional object of the present invention to provide a rotary compressor which simplifies a construction related to a vane for dividing an inside of a cylinder into a low-pressure chamber and a high-pressure chamber.

That is, in a rotary compressor according to the present embodiment of the present invention comprising an electrical-power element and a rotary compression element driven by this electrical-power element in a sealed vessel to compress a $CO_2$ refrigerant, there are provided a cylinder constituting the rotary compression element, a swing piston having a roller portion which is engaged to an eccentric portion formed on a rotary shaft of the electrical-power element to eccentrically move in the cylinder, a vane portion which is formed on this swing piston in such a manner as to project from the roller portion in a radial direction to thereby divide an inside of the cylinder into a low-pressure chamber side and a high-pressure chamber side, and a holding portion which is provided on the cylinder to hold the vane portion of the swing piston in such a manner that the vane portion can slide and swing, so that as the eccentric portion of the rotary shaft revolves eccentrically, the swing piston correspondingly swings and slides round the holding portion as a center, and therefore the vane portion thereof always divides the inside of the cylinder into the low-pressure chamber side and the high-pressure chamber side.

Accordingly, it is possible to eliminate a necessity of conventionally providing a spring for urging the vane on a roller side, a back pressure chamber, or a structure for applying a back pressure to the back pressure chamber, thus simplifying a construction of the rotary compressor and reducing costs in manufacture.

Furthermore, in a rotary compressor according to the present invention comprising an electrical-power element and first and second rotary compression elements driven by this electrical-power element in a sealed vessel in such a configuration that a $CO_2$ gas compressed at the first rotary compression element is discharged into the sealed vessel and this discharged medium pressure gas is compressed at the second rotary compression elements, there are provided a cylinder constituting the second rotary compression element, a swing piston having a roller portion which is engaged to an eccentric portion formed on a rotary shaft of the electrical-power element to eccentrically move in the cylinder, a vane portion which is formed on this swing piston in such a manner as to project from the roller portion in a radial direction in order to divide an inside of the cylinder into a low-pressure chamber side and a high-pressure chamber side, and a holding portion which is provided on the cylinder to hold the vane portion of the swing piston in such a manner that the vane can slide and swing, so that similarly, as the eccentric portion of the rotary shaft revolves eccentrically, the swing piston correspondingly swings and slides round the holding portion as a center, and therefore the vane portion thereof always divides the inside of the cylinder of the second rotary compression element into the low-pressure chamber side and the high-pressure chamber side.

Accordingly, it is possible to eliminate a necessity of conventionally providing a spring for urging the vane on the roller side, a back pressure chamber, or a structure for applying a back pressure to the back pressure chamber. Although as by the present invention the structure for applying a back pressure is complicated especially in a so-called multi-stage compression type rotary compressor which provides a medium pressure in a sealed vessel, by thus using a swing piston, it is possible to remarkably simplify a construction and reduce costs in manufacture.

Besides the above-mentioned configuration of the present invention, the holding portion is constituted of a guide groove which is formed in the cylinder and which the vane portion of the swing piston can enter movably and a bush which is provided rotatably at this guide groove to slidingly support the vane portion, so that it is possible to smooth swinging and sliding operations of the swing piston. Accordingly, it is possible to greatly improve performance and reliability of the rotary compressor.

It is another additional object of the present invention to provide a defroster which can prevent unstable operation from occurring during defrosting of an evaporator, in a refrigerant circuit using a multi-stage compression type rotary compressor.

In a refrigerant circuit comprising a multi-stage compression type rotary compressor including an electrical-power element and first and second rotary compression elements driven by this electrical-power element in a sealed vessel in such a configuration that a refrigerant compressed at the first rotary compression element is then compressed at the second rotary compression element, a gas cooler into which the refrigerant discharged from the second rotary compression element of this multi-stage compression type rotary compressor flows, a first decompression device connected to an outlet side of this gas cooler, and an evaporator connected to an outlet side of this first decompression device in such a configuration that the refrigerant discharged from this evaporator is compressed at the first rotary compression element, a defroster according to the present invention comprises a defrosting circuit for supplying the evaporator with the refrigerant, without decompressing it, discharged from the first and second rotary compression elements, a first flow-path control device which controls flow of the refrigerant through this defrosting circuit, a second decompression device provided along a refrigerant path for supplying the second rotary compression element with the refrigerant discharged from the first rotary compression element, and a second flow-path control device which controls whether the refrigerant is allowed to flow through this second decompression device or the refrigerant is allowed to bypass it, wherein this second flow-path control device allows the refrigerant to flow through the second decompression device, when the first flow-path control device allows the refrigerant to flow through the defrosting circuit, so that during defrosting operation of the evaporator, the refrigerant discharged from the first and second rotary compression elements is supplied to the evaporator without being decompressed, thus avoiding reversion in pressure level relationship at the second rotary compression element.

In particular, by the present invention, during such defrosting operation, a refrigerant is controlled to be supplied to the second rotary compression element through the decompression device provided along the refrigerant path, so that a predetermined pressure difference is established between suction and discharge sides of the second rotary compression element.

Accordingly, the second rotary compression element becomes stable in operation, thus improving reliability. Remarkable effects are obtained especially in the case of a refrigerant circuit using a $CO_2$ gas as a refrigerant.

DESCRIPTION OF THE PREFERRED EMBODIMENTS

Figure 1:
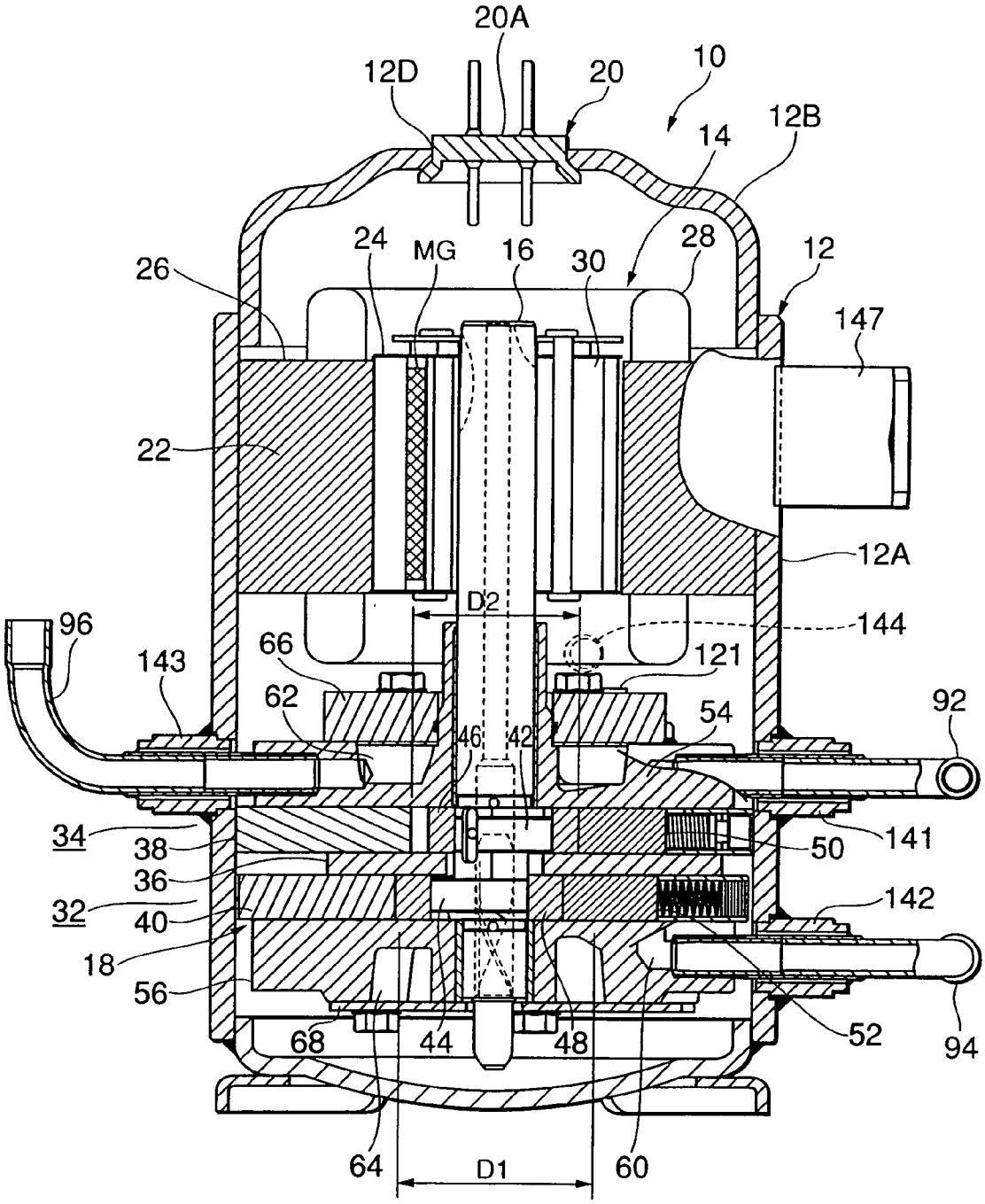
FIG. 1 is a vertical cross-sectional view for showing a multi-stage compression type rotary compressor according to an embodiment of the present invention.

The following will detail embodiments of the present invention with reference to drawings. In figures, a reference numeral 10 indicates an internal medium-pressure, multi-stage compression type rotary compressor using carbon dioxide as a refrigerant which comprises a cylindrical sealed vessel 12 made of a steel plate and a rotary compression mechanism portion 18 which includes an electrical-power element 14 arranged and housed in an upper part of an internal space of the sealed vessel and a first rotary compression element 32 (first stage) and a second rotary compression element 34 (second stage) which are arranged below the electrical-power element 14 to be driven by a rotary shaft 16 of the electrical-power element 14. The sealed vessel 12 has its bottom used as an oil reservoir and is composed of a vessel body 12A which houses the rotary compression mechanism portion 18 and the electrical-power, element 14 and a roughly cup-shaped end cap (lid) 12B which blocks an upper part opening of the vessel body 12A in such a configuration that the end cap 12B has a circular attachment hole 12D formed therein at a center of its top face, in which attachment hole 12D a terminal 20 (wiring of which is omitted) is attached which supplies power to the electrical-power element 14.

The electrical-power element 14 is composed of a stator 22 mounted annularly along an inner peripheral face of an upper-part space of the sealed vessel 12 and a rotor 24 disposed and inserted in the stator 22 with some gap set therebetween. This rotor 24 is fixed to the rotary shaft 16 which vertically extends centrally.

The stator 22 has a stack 26 formed by stacking donut-shaped electromagnetic steel plates and a stator coil 28 wound round teeth of the stack 26 by direct winding (concentrated winding). Furthermore, similar to the stator 22, the rotor 24 is also made of a stack 30 of electromagnetic steel plates and a permanent magnet MG inserted into the stack 30.

An intermediate partition plate 36 is sandwiched between the first rotary compression element 32 and the second rotary compression element 34. That is, a combination of the first rotary compression element 32 and the second rotary compression element 34 is composed of the intermediate partition plate 36, an upper cylinder 38 and a lower cylinder 40 arranged above and below the intermediate partition plate 36 respectively, an upper roller 46 and a lower roller 48 which eccentrically revolve within the upper and lower cylinders 38 and 40 respectively at upper and lower eccentric portions 42 and 44 provided on the rotary shaft 16 with a phase difference of 180 degrees therebetween, vanes 50 and 52 which butt against the upper and lower rollers 46 and 48 to divide an inside of the respective upper and lower cylinders 38 and 40 into a low-pressure chamber side and a high-pressure chamber side, and an upper-part support member 54 and a lower-part support member 56 given as a support member for blocking an upper-side opening face of the upper cylinder 38 and a lower-side opening face of the lower cylinder 40 respectively to serve also as a bearing for the rotary shaft 16.

The upper and lower cylinders 38 and 40 constituting the second and first rotary compression elements 34 and 32 respectively are made up of a material having the same thickness in the present embodiment. Furthermore, assuming an inner diameter of the cylinders 38 and 40 obtained by cutting them to be D2 and D1 respectively, when altering a displacement volume ratio between the first and second rotary compression elements 32 and 34, this ratio is set by altering the inner diameter D1 of the lower cylinder 40 of the first rotary compression element 32.

It is to be noted that when the displacement volume ratio is set by altering thickness (or height) of the lower cylinder 40, for example, it is necessary to alter all of a material of the lower cylinder 40 and thickness (or height) of the lower eccentric portion 44 and the lower roller 48. That is, in this case, it is necessary at least to alter the lower cylinder 40 and the lower roller 48 starting from their materials and also alter how to cut the rotary shaft 16 for the lower eccentric portion 44. By the present invention, on the other hand, at least the lower cylinder 40 need not be altered in material but only needs to be altered in inner diameter when being cut. Furthermore, although the lower roller 48 needs to be altered at least in outer diameter, the lower eccentric portion 44 need not be altered if the inner diameter is the same. Thus, by the present invention, the displacement volume ratio can be altered without altering at least the material of the lower cylinder 40 but by altering only a cutting process of the lower cylinder 40 and an outer diameter of the lower roller 48 or outer and inner diameters of the lower roller 48 as well as the lower eccentric portion 44. It is thus possible to set an optimal displacement volume ratio between the first and second rotary compression elements 32 and 34 while minimizing replacement of parts at the same time. It is to be noted that in the present embodiment, a displacement volume of the second rotary compression element 34 is set in a range of not less than 40% through not more than 75% of that of the first rotary compression element 32.

A combination of the upper-part support member 54 and the lower-part support member 56, on the other hand, is provided therein with a suction path 60 (and an upper-side suction path not shown) which communicate with insides of the upper and lower cylinders 38 and 40 through suction ports not shown and discharge-noise silencer chambers 62 and 64 which are formed by concaving a surface partially and then blocking resultant concavities by an upper cover 66 and a lower cover 68 respectively.

It is to be noted that the discharge-noise silencer chamber 64 communicates with an inside of the sealed vessel 12 through a communication path which penetrates the upper and lower cylinders 38 and 40 and the intermediate partition plate 36 in such a configuration that at an upper end of the communication path, an intermediate discharge pipe 121 is provided as erected, through which a medium pressure refrigerant compressed at the first rotary compression element 32 is discharged into the sealed vessel 12.

Furthermore, the upper cover 66 which blocks an upper-face opening of the discharge-noise silencer chamber 62 communicating with an inside of the upper cylinder 38 of the second rotary compression element 34 partitions the inside of the sealed vessel 12 into a side of the discharge-noise silencer chamber 62 and a side of the electrical-power element 14.

In this configuration, by the present embodiment, as a refrigerant, carbon dioxide ($CO_2$) which is a natural refrigerant friendly to environments of the earth is used taking into account inflammability, toxicity, etc., while as a lubricant, such existing oil is used as mineral oil, alkyl-benzene oil, ether oil, ester oil, or poly-alkyl glycol (PAG).

Onto a side face of the vessel body 12A of the sealed vessel 12, sleeves 141, 142, 143, and 144 are fixed by welding at positions that correspond to the suction path 60 (and an upper-side suction path not shown) of the respective upper-part support member 54 and the lower-part support member 56, the discharge-noise silencer chamber 62, and an upper side of the upper cover 66 (a lower end of the electrical-power element 14 roughly) respectively. The sleeves 141 and 142 are adjacent to each other vertically, while the sleeve 143 is roughly in a diagonal direction of the sleeve 141. Furthermore, the sleeve 144 is positioned as shifted by about 90 degrees with respect to the sleeve 141.

In the sleeve 141 is there inserted and connected one end of a refrigerant introduction pipe 92 for introducing a refrigerant gas to the upper cylinder 38, which one end communicates with the suction path, not shown, of the upper cylinder 38. This refrigerant introduction pipe 92 passes through an upper part of the sealed vessel 12 up to the sleeve 144, while the other end is inserted and connected in the sleeve 144 to communicate with the inside of the sealed vessel 12.

In the sleeve 142, on the other hand, is there inserted and connected one end of a refrigerant introduction pipe 94 for introducing a refrigerant gas to the lower cylinder 40, which one end communicates with the suction path 60 of the lower cylinder 40. The other end of this refrigerant introduction pipe 94 is connected to a lower end of an accumulator 146. Furthermore, in the sleeve 143 is there inserted and connected a refrigerant discharge pipe 96, one end of which communicates with the discharge-noise silencer chamber 62.

Figure 2:
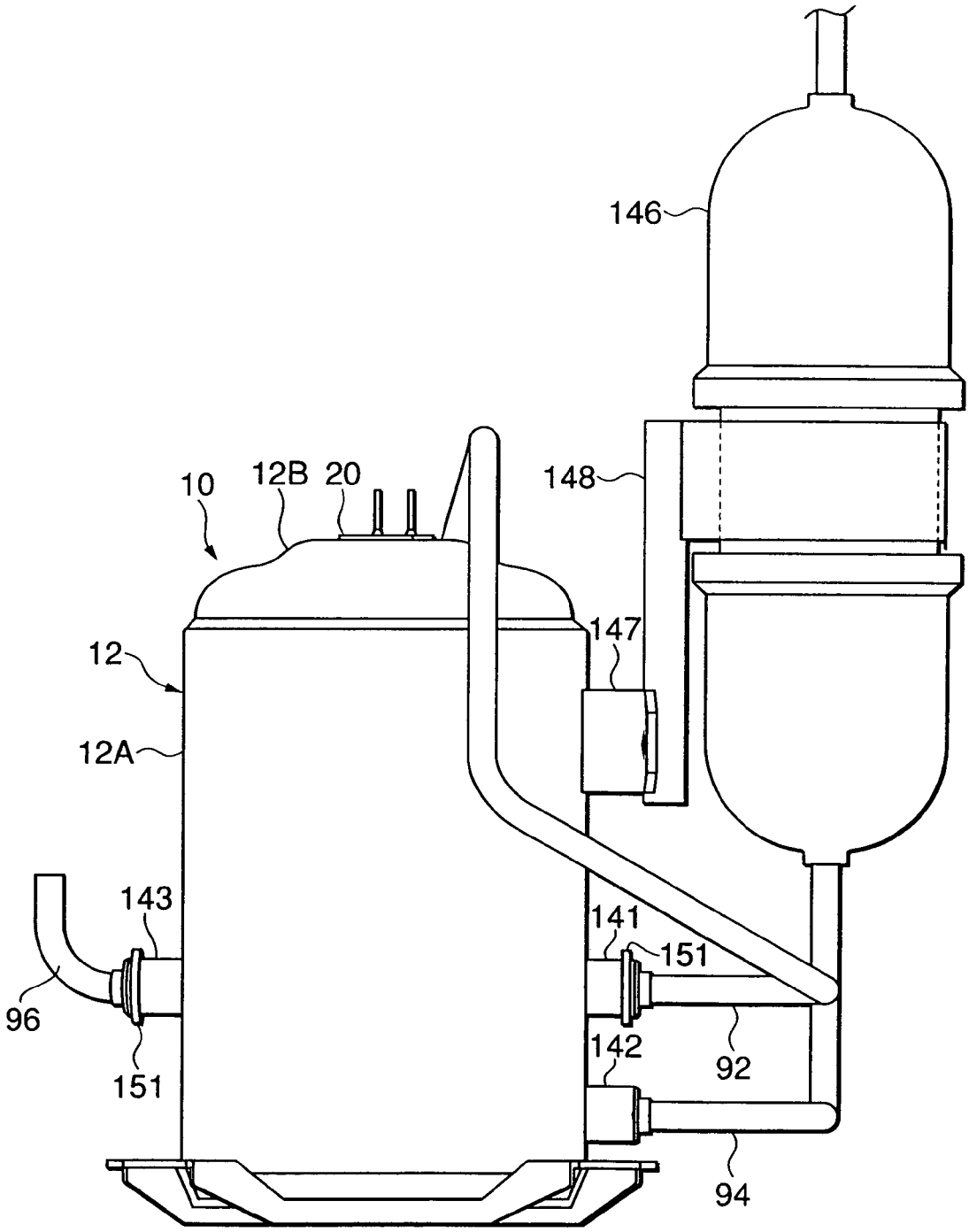
FIG. 2 is a front view for showing the rotary compressor of FIG. 1.
Figure 3:
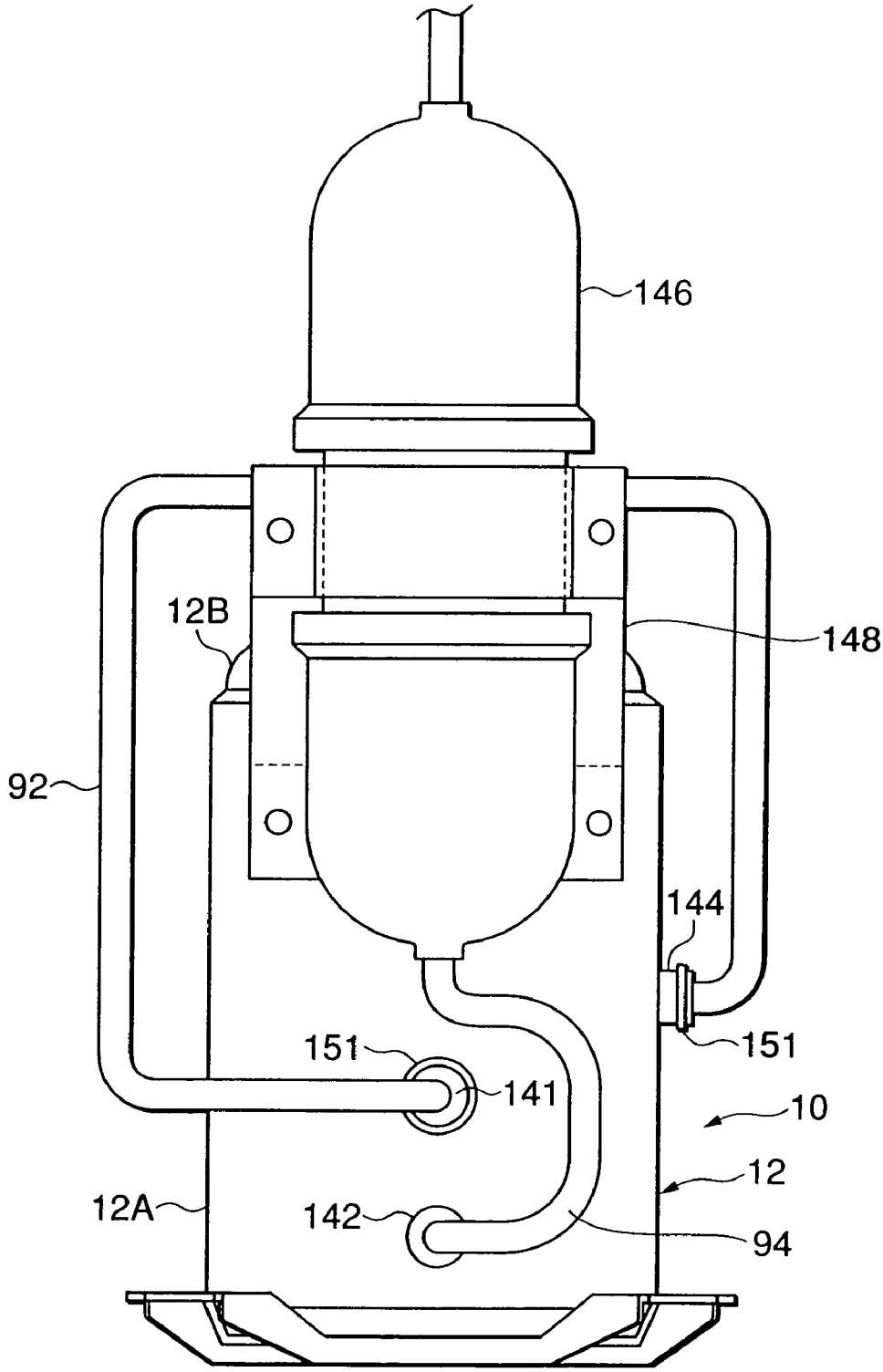
FIG. 3 is a side view for showing the rotary compressor of FIG. 1.

The accumulator 146 is a tank for separating an sucked refrigerant into vapor and liquid and attached via a bracket 148 thereof to the bracket 147 of a sealed vessel side welded and fixed to an upper-part side face of the vessel body 12A of the sealed vessel 12 (FIG. 2).

Figure 4:
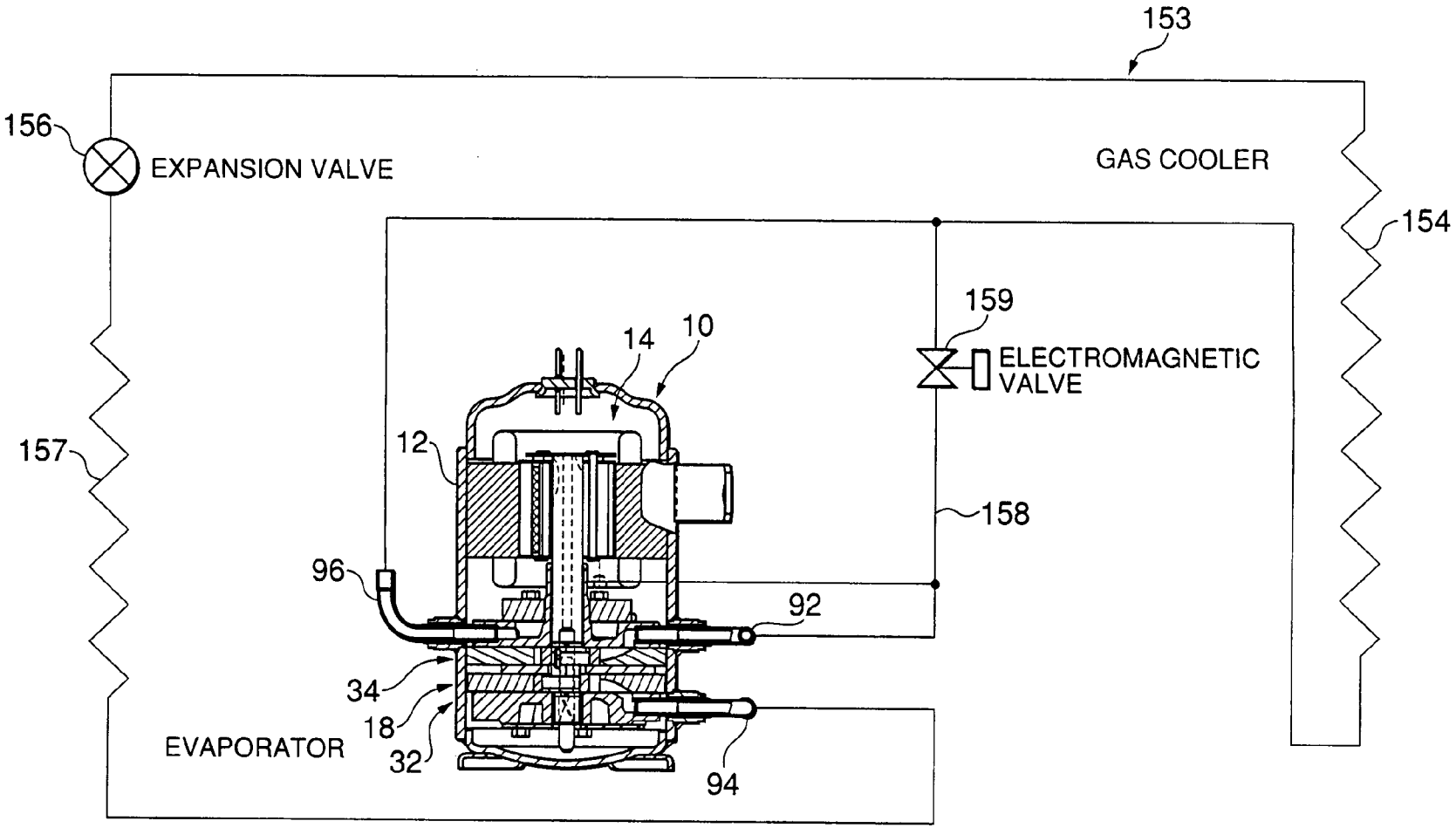
FIG. 4 is a diagram for showing a refrigerant circuit of a hot-water supply apparatus to which the rotary compressor of FIG. 1 is applied.
Figure 5:
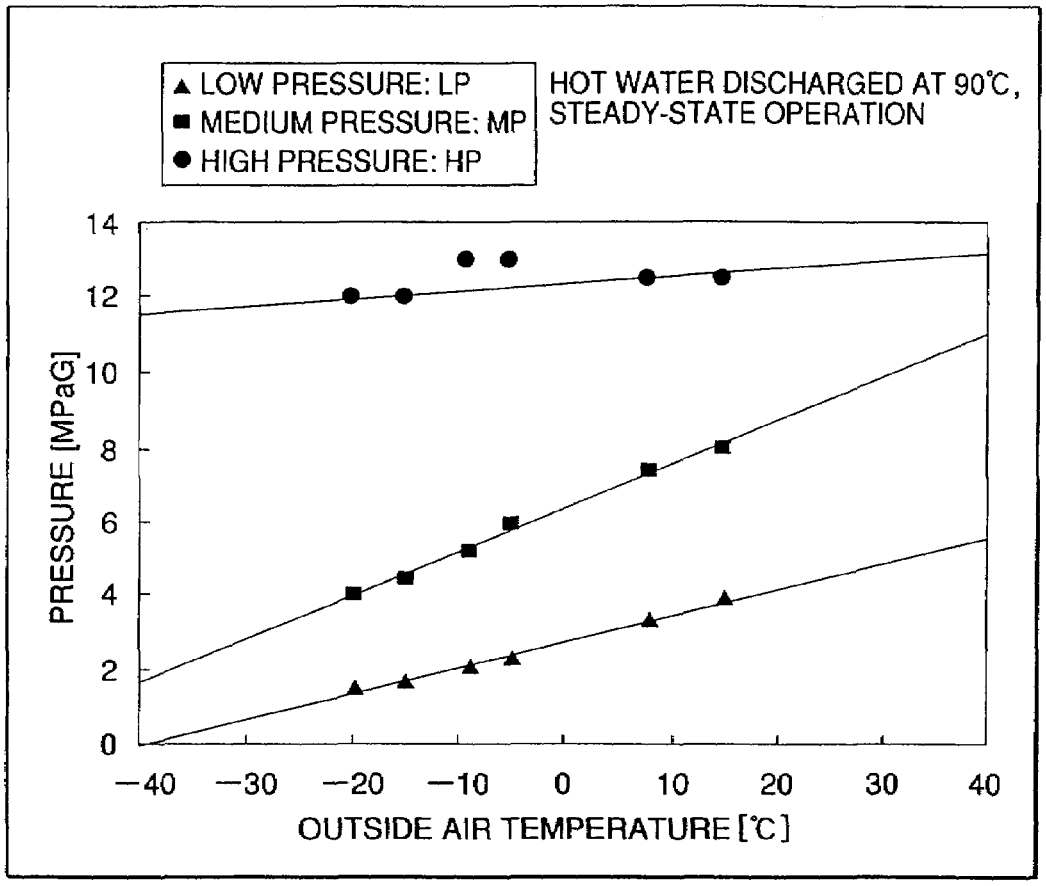
FIG. 5 is a graph for showing a relationship between an outside air temperature and various pressures in the case of a multi-stage compression type rotary compressor.

In this configuration, a multi-stage compression type rotary compressor 10 of the present embodiment is used in a refrigerant circuit of a hot-water supply apparatus 153 such as shown in FIG. 4. That is, the refrigerant discharge pipe 96 of the multi-stage compression type rotary compressor 10 is connected to an inlet of a gas cooler 154 for heating water. This gas cooler 154 is provided to a hot-water storage tank, not shown, of the hot-water supply apparatus 153. The pipe exits the gas cooler 154 and passes through an expansion valve 156, which serves as a decompression device, up to an inlet of an evaporator 157, an outlet of which is connected to the refrigerant introduction pipe 94. Furthermore, as shown in FIG. 4, a defrosting pipe 158 constituting the defrosting circuit branches from the refrigerant introduction pipe 92 at somewhere along it and is connected through an electromagnetic valve 159, which serves as a flow-path control device, to the refrigerant discharge pipe 96 extending to the inlet of the gas cooler 154. It is to be noted that the accumulator 146 is omitted in FIG. 4.

The following will describe operations with reference to this configuration. It is to be noted that the electromagnetic valve 159 is supposed to stay closed during heating. When the stator coil 28 of the electrical-power element 14 is electrified through the terminal 20 and a wiring line not shown, the electrical-power element 14 is actuated, thus causing the rotor 24 to revolve. By this revolution, the upper and lower rollers 46 and 48 are fitted to the upper and lower eccentric portions 42 and 44 provided integrally with the rotary shaft 16, to eccentrically revolve in the upper and lower cylinders 38 and 40 respectively.

Accordingly, a low-pressure refrigerant sucked into the low-pressure chamber side of the cylinder 40 from the suction port, not shown, through the refrigerant introduction pipe 94 and the suction path 60 formed in the lower-part support member 56 is compressed by operations of the roller 48 and the vane 52 to have a medium pressure, passed through the high-pressure chamber side of the lower cylinder 40, a discharge port not shown, the discharge-noise silencer chamber 64 formed in the lower-part support member 56, and the communication path not shown, and discharged into the sealed vessel 12 from the intermediate discharge pipe 121. Thus, the medium pressure develops in the sealed vessel 12.

Then, the medium pressure refrigerant gas in the sealed vessel 12 exits it through the sleeve 144, passes through the refrigerant introduction pipe 92 and the suction path, not shown, formed in the upper-part support member 54, and is sucked from the suction port, not shown, into the lower-pressure chamber side of the upper cylinder 38. The medium pressure refrigerant gas thus sucked undergoes second-stage compression through operations of the roller 46 and the vane 50 to provide a high-temperature, high-pressure refrigerant gas, which in turn passes through the high-pressure chamber side, the discharge port not shown, the discharge-noise silencer chamber 62 formed in the upper-part support member 54, and the refrigerant discharge pipe 96 to then flow into the gas cooler 154. At this moment, the refrigerant has a raised temperature of about +100° C. and, therefore, such a high temperature, high pressure gas radiates heat to heat water in the hot-water storage tank, thus generating hot water having a temperature of about +90° C.

The refrigerant itself, on the other hand, is cooled at the gas cooler 154 and exits it. Then, the refrigerant is decompressed at the expansion valve 156, flows into the evaporator 157 to evaporate there, passes through the accumulator 146 (not shown in FIG. 4), and is sucked into the first rotary compression element 32 through the refrigerant introduction pipe 94, which cycle is repeated.

Thus, by altering the inner diameter D1 of the lower cylinder 40 without altering its thickness (or height) to thus set the displacement volume of the second rotary compression element 34 at not less than 40% and not more than 75% of that of the first rotary compression element 32, a displacement volume ratio between the first and second rotary compression elements 32 and 34 is set, so that it is possible to reduce a compression load of the second rotary compression element 34 while minimizing alterations of the cylinder material and parts such as the eccentric portions and rollers as much as possible, to thereby provide an optimal displacement volume ratio with a differential pressure suppressed as much as possible. Furthermore, the rotary compression mechanism portion 18 also stays as unexpanded in vertical size, thus enabling minimizing the multi-stage compression type rotary compressor 10.

Although in the present embodiment the upper and lower cylinders 38 and 40 are supposed to have the same thickness (or height), the present invention is not limited thereto; for example, the displacement volume ratio may be set by altering the inner diameter of the cylinder of the first rotary compression element in a condition where the upper and lower cylinders 38 and 40 are different in thickness (or height) originally.

Furthermore, although the present embodiment has been described in all cases with reference to a multi-stage compression type rotary compressor in which the rotary shaft 16 is mounted vertically, of course the present invention can be applied also to a multi-stage compression type rotary compressor in which the rotary shaft is mounted horizontally. Furthermore, the multi-stage compression type rotary compressor has been described as a two-stage compression type rotary compressor equipped with first and second rotary compression elements, the present invention is not limited thereto; for example, the multi-stage compression type rotary compressor may be equipped with three, four, or even more stages of rotary compression elements.

Furthermore, although the present embodiment has used the multi-stage compression type rotary compressor 10 in a refrigerant circuit of the hot-water supply apparatus 153, the present invention is not limited thereto; for example, the present invention may well be applied for warming of a room.

As detailed above, according to the present embodiment of the present invention, when manufacturing a multi-stage compression type rotary compressor which comprises an electrical-power element and first and second rotary compression elements driven by the electrical-power element in a sealed vessel in such a configuration that the first and second rotary compression elements are constituted of first and second cylinders and first and second rollers which are fitted to first and second eccentric portion formed on a rotary shaft of the electrical-power element so as to eccentrically revolve in the cylinders respectively and also that a refrigerant gas compressed in the first rotary compression element and discharged therefrom is sucked into the second rotary compression element to be compressed and discharged therefrom, an inner diameter of the first cylinder is altered without altering its thickness (or height) to thereby set a displacement volume ratio between the first and second rotary compression elements, so that costs can be reduced without replacing all of a cylinder material and the roller of the first rotary compression element, the eccentric portion of the rotary shaft, etc. as much as possible, for example, by replacing only the roller or only the roller and the eccentric portion. Furthermore, it is possible to prevent an increase in overall size of the compressor, thus reducing dimensions thereof. Also, for example, by setting the displacement volume of the second rotary compression element at not less than 40% and not more than 75% of that of the first rotary compression element, a displacement volume ratio between the first and second rotary compression elements can be optimized.

Figure 6:
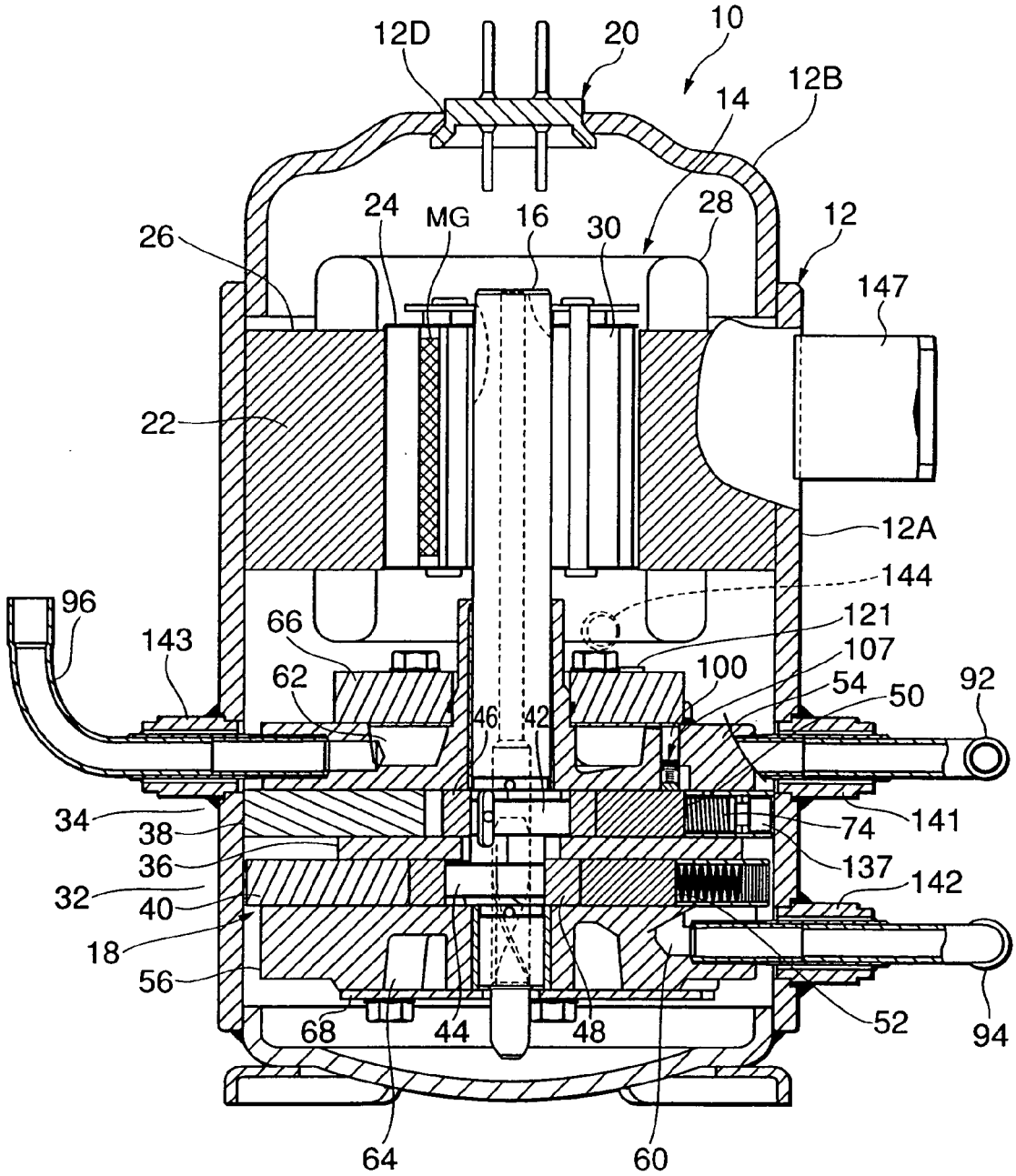
FIG. 6 is a vertical cross-sectional view for showing a multi-stage compression type rotary compressor according to another embodiment of the present invention.
Figure 7:
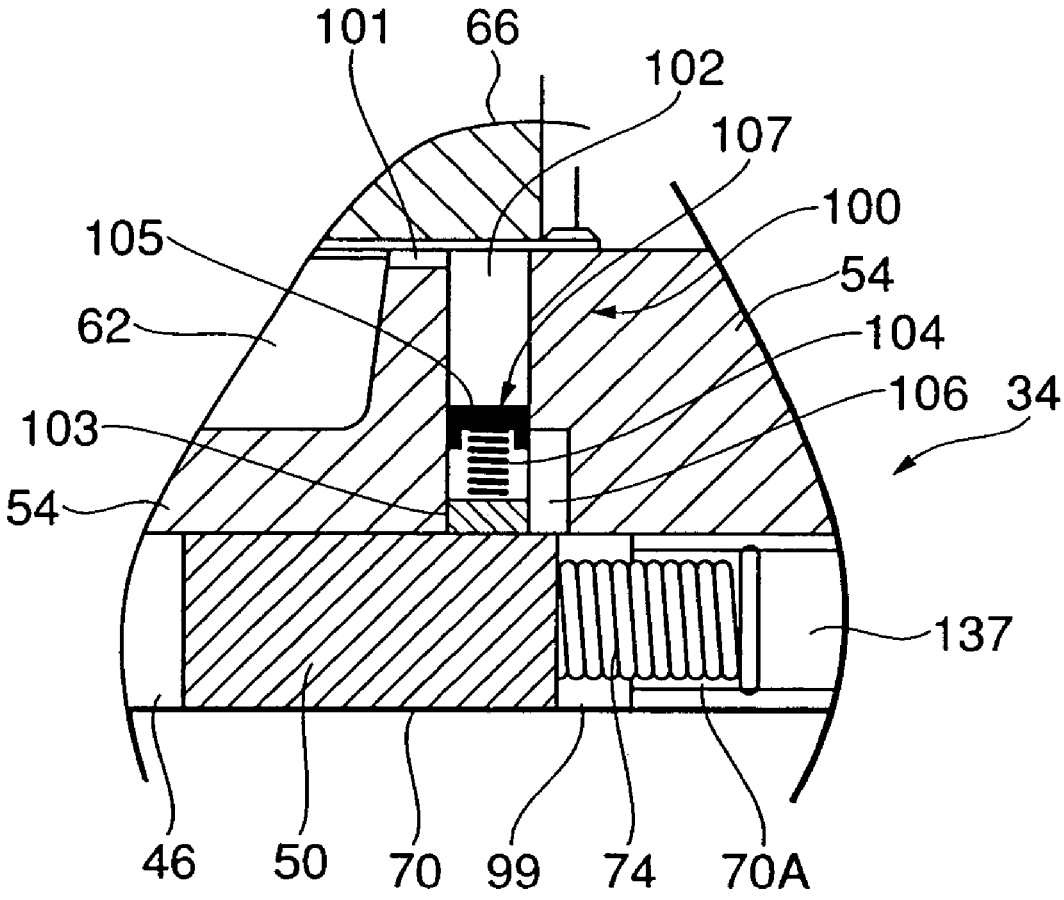
FIG. 7 is an expanded cross-sectional view for showing a pressure adjustment valve of a second rotary compression element of the multi-stage compression type rotary compressor of FIG. 6.

The following will describe a multi-stage compression type rotary compressor according to another embodiment of the present invention with reference to FIGS. 6 and 7. FIG. 6 is a vertical cross-sectional view of the multi-stage compression type rotary compressor according to the present embodiment of the present invention and FIG. 7, an expanded cross-sectional view of a pressure adjustment valve 107 of the rotary compressor 10. It is to be noted that the same reference numerals in FIGS. 6 and 7 as those in FIGS. 1–5 indicate the same or similar functions.

In the figures, a reference numeral 10 indicates the internal medium-pressure, multi-stage compression type rotary compressor using carbon dioxide ($CO_2$) as a refrigerant which comprises the cylindrical sealed vessel 12 made of a steel plate and the rotary compression mechanism portion 18 which includes the electrical-power element 14 arranged and housed in an upper part of an internal space of the sealed vessel 12 and the first rotary compression element 32 (first stage) and the second rotary compression element 34 (second stage) which are arranged below the electrical-power element 14 to be driven by the rotary shaft 16 of the electrical-power element 14.

The sealed vessel 12 has its bottom used as an oil reservoir and is composed of the vessel body 12A which houses the rotary compression mechanism portion 18 and the electrical-power element 14 and the roughly cup-shaped end cap (lid) 12B which blocks an upper part opening of the vessel body 12A in such a configuration that the end cap 12B has the circular attachment hole 12D formed therein at a center of its top face, in which attachment hole 12D the terminal 20 (wiring of which is omitted) is attached which supplies power to the electrical-power element 14.

The electrical-power element 14 is composed of the stator 22 mounted annularly along an inner peripheral face of an upper-part space of the sealed vessel 12 and the rotor 24 disposed and inserted in the stator 22 with some gap set therebetween. This rotor 24 is fixed to the rotary shaft 16 which vertically extends centrally.

The stator 22 has the stack 26 formed by stacking donut-shaped electromagnetic steel plates and the stator coil 28 wound round teeth of the stack 26 by direct winding (concentrated winding). Furthermore, similar to the stator 22, the rotor 24 is also made of the stack 30 of electromagnetic steel plates and the permanent magnet MG inserted into the stack 30.

The intermediate partition plate 36 is sandwiched between the first rotary compression element 32 and the second rotary compression element 34. That is, a combination of the first rotary compression element 32 and the second rotary compression element 34 is composed of the intermediate partition plate 36, the upper cylinder 38 and the lower cylinder 40 arranged above and below the intermediate partition plate 36 respectively, the upper roller 46 and the lower roller 48 which are fitted to the upper and lower eccentric portions 42 and 44 provided on the rotary shaft 16 with a phase difference of 180 degrees set therebetween so as to eccentrically revolve within the upper and lower cylinders 38 and 40 respectively, the upper and lower vanes 50 and 52 which butt against the upper and lower rollers 46 and 48 to divide respective upper and lower cylinders 38 and 40 into a low-pressure chamber side and a high-pressure chamber side, and the upper-part support member 54 and the lower-part support member 56 given as a support member for blocking an upper-side opening face of the upper cylinder 38 and a lower-side opening face of the lower cylinder 40 respectively to serve also as a bearing for the rotary shaft 16.

It is to be noted that a displacement volume ratio between the first rotary compression element 32 and the second rotary compression element 34 is supposed to be (displacement volume of the second rotary compression element 34)/(displacement volume of the first rotary compression element 32)×100=30–75%.

As shown in FIG. 7, within the upper cylinder 38 constituting the second rotary compression element 34, a guide groove 70 for housing the vane 50 is formed; and outside the guide groove 70, that is, on a rear face side of the vane 50, there is formed a housing portion 70A for housing a spring 74 serving as a spring member. The spring 74 butts against a rear face side end of the vane 50 to thereby always urge the vane 50 on the roller 46. The housing portion 70A has an opening on a side of the guide groove 70 and a side of the sealed vessel 12 (vessel body 12A) and is provided with a metal-made plug 137 on a side of the sealed vessel 12 with respect to the spring 74 housed in the housing portion 70A for preventing fall-out of the spring 74. Furthermore, on a peripheral face of the plug is there attached an O-ring, not shown, for sealing an inner face of this plug 137 and that of the housing portion 70A off each other.

Furthermore, between the guide groove 70 and the housing portion 70A is there provided a back pressure chamber 99 which applies a refrigerant discharge pressure of the second rotary compression element 34 to the vane 50 to work with the spring 74 in order to always urge the vane 50 on the roller 46. An upper face of this back pressure chamber 99 communicates with a later-described second path 106.

Furthermore, a combination of the upper-part support member 54 and the lower-part support member 56 is provided therein the suction path 60 (and upper-side suction path not shown) communicating with insides of the upper and lower cylinders 38 and 40 respectively through a suction port not shown and the discharge-noise silencer chambers 62 and 64 formed by concaving a surface partially and blocking resultant concavities by the upper and lower covers 66 and 68 respectively.

It is to be noted that the discharge-noise silencer chamber 64 and an inside of the sealed vessel 12 communicate to each other through an communication path which penetrates the upper and lower cylinder 38 and 40 and the intermediate partition plate 36 in such a configuration that at an upper end of the communication path is there provided the intermediate discharge pipe 121 as erected, from which pipe 121 a medium pressure refrigerant gas compressed at the first rotary compression element 32 is discharged into the sealed vessel 12.

In this configuration, the upper cover 66 which blocks the upper-face opening of the discharge-noise silencer chamber 62 communicating with an inside of the upper cylinder 38 of the second rotary compression element 34 partitions an inside of the sealed vessel 12 into the discharge-noise silencer chamber 62 and a side of the electrical-power element 14.

Furthermore, a communication path 100 is formed in the upper-part support member 54. This communication path 100 is provided to communicate to each other the back pressure chamber 99 and the discharge-noise silencer chamber 62 which communicates with a discharge port, not shown, of the upper cylinder 38 of the second rotary compression element 34 and is constituted of a valve housing chamber 102 which penetrates the upper-part support member 54 vertically and has its upper side blocked by the upper cover 66, a first path 101 which communicates an upper end of this valve housing chamber 102 and the discharge-noise silencer chamber 62 to each other, and a second path 106 which is positioned outside the valve housing chamber 102 to communicate this valve housing chamber 102 and the back pressure chamber 99 to each other as shown in FIG. 7.

The valve housing chamber 102 is a cylindrical hole extending vertically and has its lower end blocked by a sealing agent 103. On a upper side of the sealing agent 103 is there attached a lower end of a valve disc 104 (coil spring), at an upper end of which is in turn attached a valve disc 105. This valve disc 105 is provided in the valve housing chamber 102 vertically movably and butts against a peripheral wall of this valve housing chamber 102 as sliding to divide the valve housing chamber 102 vertically. These valve disc 105 and spring member 104 constitute a pressure adjustment valve 107 of the present invention.

The second path 106 is formed from a position below a lower end of the valve housing chamber 102 by a predetermined distance down to the back pressure chamber 99 in such a configuration that if the valve disc 105 is above the path 106, the communication path 100 is closed and, if an upper face of the valve disc 105 is below an upper end of the second path 106, the communication path 100 is opened. The spring member 104 always urges this valve disc 105 in such a direction as to raise it.

Furthermore, the valve disc 105 receives downward force due to a high pressure refrigerant gas flowing through the first path 101 into the valve housing chamber 102 and upward force due to a pressure in the back pressure chamber 99 through the second path 106. That is, the valve disc 105 moves downward and upward respectively owing to a pressure of the refrigerant gas compressed in the upper cylinder 38 of the second rotary compression element 34 and discharged into the discharge-noise silencer chamber 62 and a combination of urging force of the spring member 104 and a pressure in the back pressure chamber 99.

The urging force of this spring member 104 is supposed to be set so that if, for example, a pressure difference between the discharge-noise silencer chamber 62 and the back pressure chamber 99 (pressure of the discharge-noise silencer chamber 62—pressure of the back pressure chamber 99) becomes larger than, for example, 2 MPaG, an upper face of the valve is lowered below the upper end of the second path 106 to thereby open the communication path 100 and, if the pressure difference becomes 2 MPaG or less, the valve disc 105 is raised until its upper face exceeds in height the upper end of the second path 106 to thereby close the communication path 100.

In this case, as a refrigerant, carbon dioxide ($CO_2$), which is a natural refrigerant friendly to environments of the earth, is used taking into account inflammability, toxicity, etc., while as a lubricant, such existing oil is used as mineral oil, alkyl-benzene oil, ether oil, ester oil, or poly-alkyl glycol (PAG).

On a side face of the vessel body 12A of the sealed vessel 12, the sleeves 141, 142, 143, and 144 are fixed by welding at positions that correspond to the suction path 60 (and an upper-side suction path not shown) of the respective upper-part support member 54 and the lower-part support member 56, the discharge-noise silencer chamber 62, and an upper side of the upper cover 66 (a lower end of the electrical-power element 14 roughly) respectively. The sleeves 141 and 142 are adjacent to each other vertically, while the sleeve 143 is roughly in a diagonal direction of the sleeve 141. Furthermore, the sleeve 144 is positioned as shifted by about 90 degrees with respect to the sleeve 141.

In the sleeve 141 is there inserted and connected one end of the refrigerant introduction pipe 92 for introducing a refrigerant gas to the upper cylinder 38, which one end communicates with a suction path, not shown, of the upper cylinder 38. This refrigerant introduction pipe 92 passes through the upper part of the sealed vessel 12 up to the sleeve 144, while the other end is inserted and connected in the sleeve 144 so as to communicate with an inside of the sealed vessel 12.

In the sleeve 142, on the other hand, is there inserted and connected one end of the refrigerant introduction pipe 94 for introducing a refrigerant gas to the lower cylinder 40, which one end communicates with the suction path 60 of the lower cylinder 40. The other end of this refrigerant introduction pipe 94 is connected to a lower end of the accumulator 146. Furthermore, in the sleeve 143 is there inserted and connected the refrigerant discharge pipe 96, one end of which communicates with the discharge-noise silencer chamber 62.

The accumulator 146 is a tank for separating an sucked refrigerant into vapor and liquid and attached via the bracket 148 thereof to the bracket 147 of a sealed vessel side welded and fixed to an upper-part side face of the vessel body 12A of the sealed vessel 12 (see FIG. 2).

Accordingly, the multi-stage compression type rotary compressor 10 of the present embodiment is used in a refrigerant circuit of a hot-water supply apparatus such as shown in FIG. 4. That is, the refrigerant discharge pipe 96 of the multi-stage compression type rotary compressor 10 is connected to the inlet of the gas cooler 154 for heating water. This gas cooler 154 is provided to a hot-water storage tank, not shown, of the hot-water supply apparatus 153. The pipe exits the gas cooler 154 and passes through the expansion valve 156 serving as a decompression device up to an inlet of the evaporator 157, an outlet of which is connected to the refrigerant introduction pipe 94. Furthermore, as shown in FIG. 4, the defrosting pipe 158 constituting the defrosting circuit branches from the refrigerant introduction pipe 92 at somewhere along it and is connected through the electromagnetic valve 159 serving as a flow-path control device to the refrigerant discharge pipe 96 extending to the inlet of the gas cooler 154.

The following will describe operations with reference to this configuration. It is to be noted that the electromagnetic valve 159 is supposed to stay closed during ordinary heating. When the stator coil 28 of the electrical-power element 14 is electrified through the terminal 20 and a wiring line not shown, the electrical-power element 14 is actuated, thus causing the rotor 24 to revolve. By this revolution, the upper and lower rollers 46 and 48 are fitted to the upper and lower eccentric portions 42 and 44 provided integrally with the rotary shaft 16, to eccentrically revolve in the upper and lower cylinders 38 and 40 respectively.

Accordingly, a low-pressure (first-stage suction pressure: 4 MPaG) refrigerant sucked into the low-pressure chamber side of the cylinder 40 from a suction port, not shown, through the refrigerant introduction pipe 94 and the suction path 60 formed in the lower-part support member 56 is compressed by operations of the lower roller 48 and the vane 52 to have a medium pressure (first-stage discharge pressure: 8 MPaG), passed through the high-pressure chamber side of the lower cylinder 40 and a discharge port not shown, and discharged into the discharge-noise silencer chamber 64 formed in the lower-part support member 56. Then, the medium pressure refrigerant gas discharged into the discharge-noise silencer chamber 64 is discharged through the communication path into the sealed vessel 12 from the intermediate discharge pipe 121, thus providing the medium pressure (8 MPaG) in the sealed vessel 12.

Then, the medium pressure refrigerant gas in the sealed vessel 12 exits it through the sleeve 144, passes through the refrigerant introduction pipe 92 and the suction path, not shown, formed in the upper-part support member 54, and is sucked from a suction port, not shown, into the lower-pressure chamber side of the upper cylinder 38. The medium pressure refrigerant gas thus sucked undergoes second-stage compression through operations of the roller 46 and the vane 50 to provide a high-temperature, high-pressure refrigerant gas (second-stage discharge pressure: 12 MPaG), which in turn passes from the high-pressure chamber side and a discharge port not shown to be discharged into the discharge-noise silencer chamber 62 formed in the upper-part support member 54.

The refrigerant gas thus sucked into the discharge-noise silencer chamber 62 flows into the gas cooler 154 from the refrigerant discharge pipe 96. At this moment, the refrigerant has a raised temperature of about +100° C. and, therefore, such a high temperature, high pressure gas radiates heat to heat water in the hot-water storage tank to thus generate hot water having a temperature of about +90° C.

The refrigerant itself, on the other hand, is cooled at the gas cooler 154 and exits it. Then, the refrigerant is decompressed at the expansion valve 156, flows into the evaporator 157 to evaporate there, passes through the accumulator 146, and is sucked into the first rotary compression element 32 through the refrigerant introduction pipe 94, which cycle is repeated.

During such heating operation, a pressure in the discharge-noise silencer chamber 62 reaches an extremely high value of 12 MPaG as mentioned above, so that if a pressure of the back pressure chamber 99 is lower than the pressure in the discharge-noise silencer chamber 99 with a difference therebetween being larger than 2 MPaG, as mentioned above, the valve disc 105 of the pressure adjustment valve 107 opens the communication path 100. Accordingly, the high-pressure refrigerant gas in the discharge-noise silencer chamber 62 flows into the back pressure chamber 99.

If such introduction of the pressure increases a pressure in the back pressure chamber 99 until the difference between the pressure in the back pressure chamber 99 and the pressure in the discharge-noise silencer chamber 62 decreases to 2 MPaG, as mentioned above, the valve disc 105 of the pressure adjustment valve 107 closes the communication path 100, thus stopping flow of the refrigerant gas into the back pressure chamber.

In such a manner, when the second-stage discharge pressure is 12 MPaG, a pressure in the back pressure chamber 99 is held at about 10 MPaG higher than the medium pressure 8 MPaG and lower than the second-stage discharge pressure 12 MPaG, so that it is possible to prevent the back pressure higher than necessary from being applied to the vane 50 while preventing a so-called vane breakaway, thus optimizing force for urging the vane 50 on the upper roller 46. Accordingly, it is possible to reduce a load applied to a portion where a tip of the vane slides along an outer periphery of the roller to thereby improve durability of the vane 50 and the upper roller 46, thus avoiding damages of the vane and the roller beforehand.

In this case, especially in a low outside-air temperature environment, heating operation causes the evaporator 157 to be frosted. In such a case, the electromagnetic valve 159 is opened and the expansion valve 156 is opened fully to defrost the evaporator 157. Thus, a medium-pressure refrigerant in the sealed vessel 12 (including a small amount of high pressure refrigerant discharged from the second rotary compression element 34) passes through the defrosting pipe 158 to reach the gas cooler 154. This refrigerant has a temperature of roughly +50° C. through +60° C. and so radiates no heat at the gas cooler 154 but, instead, absorbs heat at the beginning. Then, the refrigerant discharged from the gas cooler 154 passes through the expansion valve 156 to reach the evaporator 157. That is, the roughly medium-pressure, comparatively high-temperature refrigerant is essentially supplied to the evaporator 157 directly without being decompressed, thus heating the evaporator 157 to defrost it.

Thus, the rotary compressor according to the present embodiment which comprises the electrical-power element 14 and the first and second rotary compression elements 32 and 34 driven by the electrical-power element 14 in the sealed vessel 12 in such a configuration that a refrigerant gas compressed at the first rotary compression element 32 is discharged into the sealed vessel 12 and this medium pressure refrigerant gas thus discharged is then compressed at the second rotary compression element 34, wherein there are also provided the upper cylinder 38 constituting the second rotary compression element 34, the upper roller 46 which is fitted to the upper eccentric portion 42 formed on the rotary shaft 16 of the electrical-power element 14 to thereby eccentrically revolves in the upper cylinder 38, the vane 50 which butts against this upper roller 46 to divide an inside of the upper cylinder 38 into a low-pressure chamber side and a high-pressure chamber side, the back pressure chamber 99 which urges this vane 50 on a side of the upper roller 46 always, the communication path 100 which communicates a refrigerant discharge side of the second rotary compression element 34 and the back pressure chamber 99 to each other, and the pressure adjustment valve 107 for adjusting a pressure applied to the back pressure chamber 99 through this communication path, so that by using this pressure adjustment valve 107 to set a pressure of the back pressure chamber 99 to a predetermined value lower than a high pressure on the refrigerant discharge side of the second rotary compression element 34 and higher than a medium pressure in the sealed vessel 12, it is possible to prevent a back pressure higher than necessary from being applied to the vane 50 while preventing the so-called vane breakaway, thus optimizing force for urging the vane 50 on the upper roller 46.

Accordingly, it is possible to reduce a load applied to a portion where a tip of the vane slides along an outer periphery of the upper roller 46 to thereby improve durability of the vane 50 and the upper roller 46, thus avoiding damages of the vane and the roller beforehand.

In particular, the communication path 100 is formed in the upper-side support member 54 to communicate the discharge-noise silencer chamber 62 and the back pressure chamber 99 to each other and also the pressure adjustment valve 107 is provided in the upper-part support member 54, so that it is possible to adjust a pressure in the back pressure chamber 99 of the vane 50 without complicating a construction while effectively utilizing an internal limited space of the sealed vessel 12. Furthermore, since the communication path 100 and the pressure adjustment valve 107 can be provided in the upper-part support member 54 beforehand, a work efficiency in assembly can be improved.

It is to be noted that pressure values employed on the present embodiment are not restrictive and so may be set appropriately corresponding to a capacity and a function of various compressors. Furthermore, although the present embodiment has been described with reference to a multi-stage compression type rotary compressor 10 in which the rotary shaft 16 is mounted vertically, of course the present invention can be applied also to a multi-stage compression type rotary compressor in which the rotary shaft is mounted horizontally.

Furthermore, the multi-stage compression type rotary compressor has been described as a two-stage compression type rotary compressor equipped with first and second rotary compression elements, the present invention is not limited thereto; for example, the multi-stage compression type rotary compressor may be equipped with three, four, or even more stages of rotary compression elements. Furthermore, although the present embodiment has used the multi-stage compression type rotary compressor 10 in a refrigerant circuit of the hot-water supply apparatus 153, the present invention is not limited thereto; for example, the present invention may well be applied for warming of a room.

As detailed above, by the present invention, in a multi-stage compression type rotary compressor according to the present embodiment which comprises an electrical-power element and first and second rotary compression elements driven by this electrical-power element in a sealed vessel in such a configuration that a refrigerant gas compressed at the first rotary compression element is discharged into the sealed vessel and this medium pressure refrigerant gas thus discharged is compressed at the second rotary compression element, there are also provided a cylinder constituting the second rotary compression element, a roller which is fitted to an eccentric portion formed on a rotary shaft of the electrical-power element to thereby eccentrically revolves in the cylinder, a vane which butts against this roller to divide an inside of the cylinder into a low-pressure chamber side and a high-pressure chamber side, a back pressure chamber which always urges this vane on a side of the roller, a communication path which communicates a refrigerant discharge side of the second rotary compression element and the back pressure chamber to each other, and a pressure adjustment valve for adjusting a pressure applied to the back pressure chamber through this communication path, so that by setting a pressure of the back pressure chamber at a predetermined value lower than a pressure on a refrigerant discharge side of the second rotary compression element and higher than a pressure in the sealed vessel 12, it is possible to prevent a back pressure higher than necessary from being applied to the vane while preventing the so-called vane breakaway, thus optimizing force for urging the vane on the roller.

Accordingly, it is possible to reduce a load applied to a portion where a tip of the vane slides along an outer periphery of the roller to thereby improve durability of the vane and the roller, thus avoiding damages of the vane and the roller beforehand.

Furthermore, there are also provided a support member which blocks an opening face of the cylinder and also which has a bearing for the rotary shaft of the electrical-power element and a discharge-noise silencer chamber arranged in this support member in such a configuration that the communication path is formed in the support member to communicate the discharge-noise silencer chamber and the back pressure chamber to each other and also the pressure adjustment valve is provided in the support member, so that it is possible to adjust a pressure in the back pressure chamber of the vane without complicating a construction while effectively utilizing an internal limited space of the sealed vessel. Furthermore, since the communication path and the pressure adjustment valve can be provided in the support member beforehand, a work efficiency in assembly can be improved.

Figure 8:
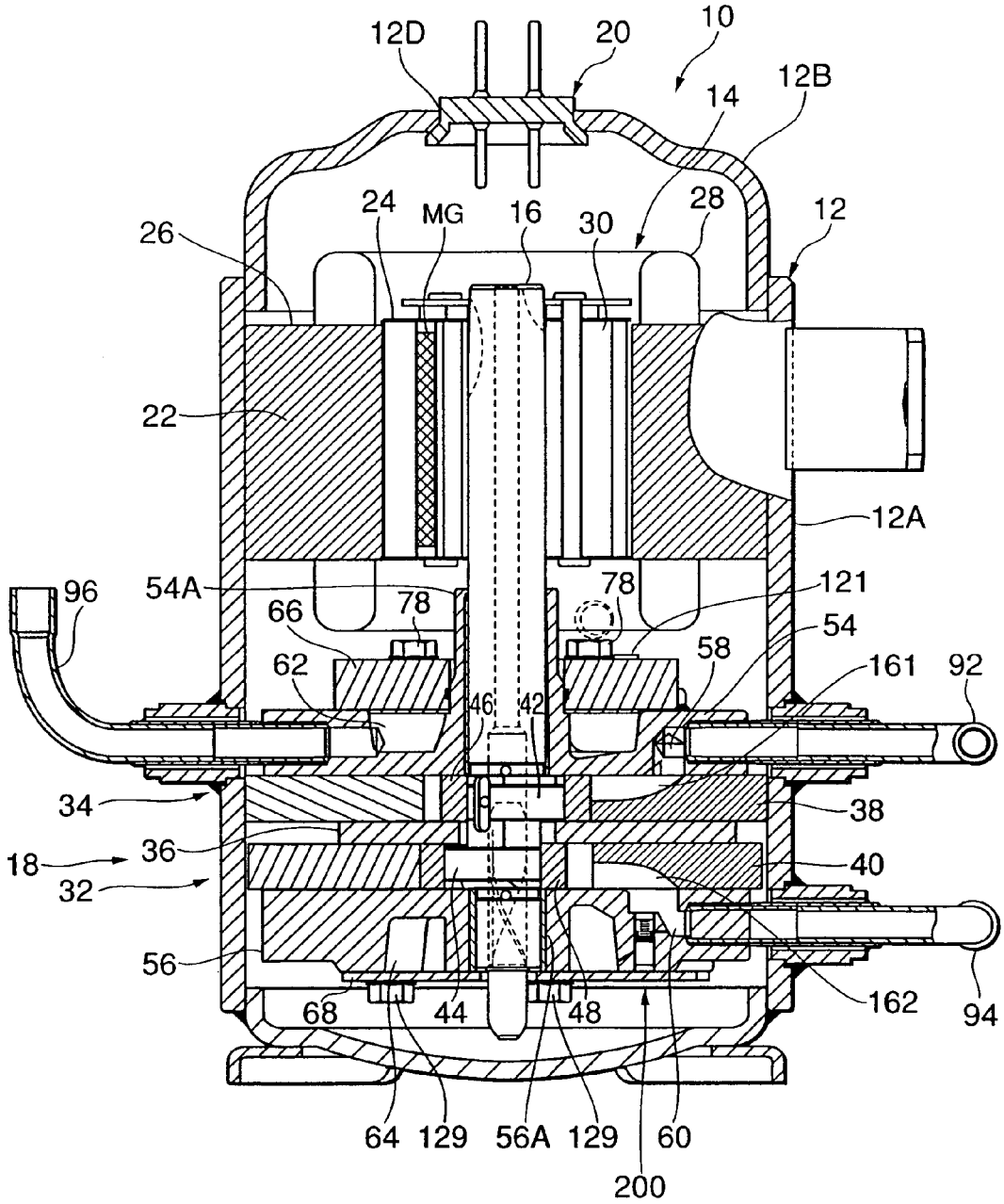
FIG. 8 is a vertical cross-sectional view for showing a multi-stage compression type rotary compressor according to a further embodiment of the present invention.

The following will describe a multi-stage compression type rotary compressor according to a further embodiment of the present invention with reference to FIGS. 8–13. FIG. 8 is a vertical cross-sectional view of the multi-stage compression type rotary compressor according to the present embodiment. It is to be noted that the same reference numerals in these figures as those in FIGS. 1–5 have the same or similar functions.

In FIG. 8, a reference numeral 10 indicates an internal medium-pressure, multi-stage compression type rotary compressor using carbon dioxide as a refrigerant which comprises the cylindrical sealed vessel 12 made of a steel plate and a rotary compression mechanism portion 18 which includes an electrical-power element 14 arranged and housed in an upper part of an internal space of the sealed vessel 12 and the first rotary compression element 32 (first stage) and the second rotary compression element 34 (second stage) which are arranged below the electrical-power element 14 to be driven by the rotary shaft 16 of the electrical-power element 14.

The sealed vessel 12 has its bottom used as an oil reservoir and is composed of the vessel body 12A which houses the rotary compression mechanism portion 18 and the electrical-power element 14 and the roughly cup-shaped end cap (lid) 12B which blocks an upper part opening of the vessel body 12A in such a configuration that the end cap 12B has the circular attachment hole 12D formed therein at a center of its top face, in which attachment hole 12D the terminal 20 (wiring of which is omitted) is attached which supplies power to the electrical-power element 14.

The electrical-power element 14 is composed of the stator 22 mounted annularly along an inner peripheral face of an upper-part space of the sealed vessel 12 and the rotor 24 disposed and inserted in the stator 22 with some gap set therebetween. This rotor 24 is fixed to the rotary shaft 16 which vertically extends centrally.

The stator 22 has the stack 26 formed by stacking donut-shaped electromagnetic steel plates and the stator coil 28 wound round teeth of the stack 26 by direct winding (concentrated winding). Furthermore, similar to the stator 22, the rotor 24 is also made of the stack 30 of electromagnetic steel plates and the permanent magnet MG inserted into the stack 30.

The intermediate partition plate 36 is sandwiched between the first rotary compression element 32 and the second rotary compression element 34. That is, a combination of the first rotary compression element 32 and the second rotary compression element 34 is composed of the intermediate partition plate 36, the upper and lower cylinders 38 and 40 arranged above and below this intermediate partition plate 36 respectively, the upper and lower rollers 46 and 48 which are fitted to the upper and lower eccentric portions 42 and 44 provided on the rotary shaft 16 with a phase difference of 180 degrees therebetween to thereby eccentrically revolve within these upper and lower cylinders 38 and 40 respectively, the upper and lower vanes 50 and 52 which butt against the upper and lower rollers 46 and 48 to divide an inside of the respective upper and lower cylinders 38 and 40 into a low-pressure chamber side and a high-pressure chamber side, and the upper-part support member 54 and the lower-part support member 56 given as a support member for blocking an upper-side opening face of the upper cylinder 38 and a lower-side opening face of the lower cylinder 40 respectively to serve also as a bearing for the rotary shaft 16.

A combination of the upper-part support member 54 and the lower-part support member 56 is provided therein with the suction paths 58 and 60 which communicate with insides of the upper and lower cylinders 38 and 40 through suction ports 161 and 162 respectively and the concave discharge-noise silencer chambers 62 and 64 in such a configuration that openings of these two discharge-noise silencer chambers 62 and 64 are blocked by respective covers. That is, the discharge-noise silencer chamber 62 is blocked by the upper cover 66 serving as a cover and the discharge-noise silencer chamber 64, by the lower cover 68 serving as a cover.

In this case, a bearing 54A is formed as erected at a center of the upper-part support member 54. At a center of the lower-part support member 56 is there formed a bearing 56A as going through, so that the rotary shaft 16 is held by the bearing 54A of the upper-part support member 54 and the bearing 56A of the lower-part support member 56.

Figure 9:
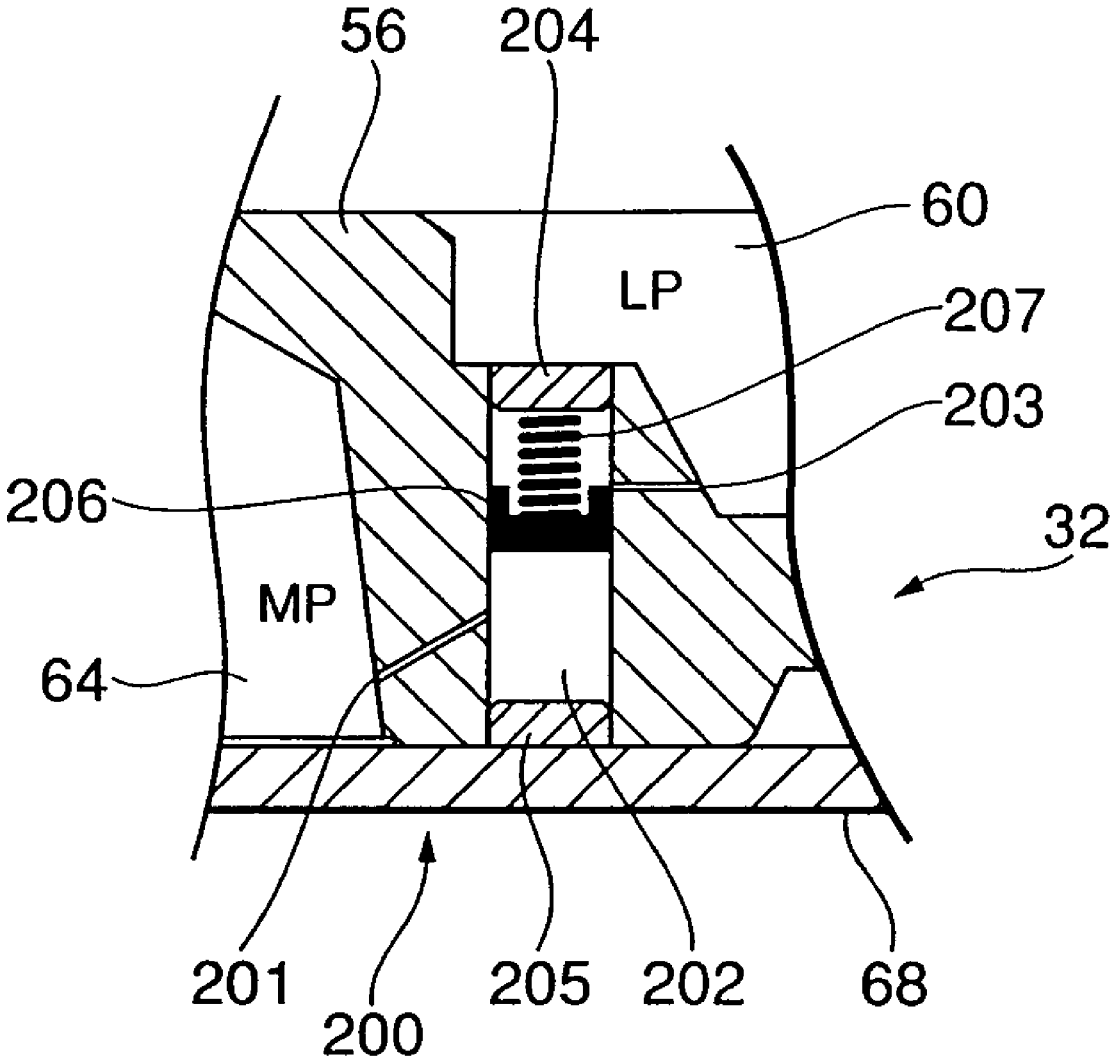
FIG. 9 is an expanded cross-sectional view for showing a communication path portion of a first rotary compression element of the multi-stage compression type rotary compressor of FIG. 8.

It is to be noted that a communication path 200 is formed in the lower-part support member 56 between the suction path 60 of the first rotary compression element 32 and the discharge-noise silencer chamber 64. This communication path 200 communicates, to each other, the suction path 60 which is on a refrigerant suction side of the first rotary compression element 32 and the discharge-noise silencer chamber 64 which is on a refrigerant discharge side where a medium refrigerant compressed at the first rotary compression element 32 is discharged, details of which path 200 are shown in FIG. 9. That is, one end of a first path 201 opens into the discharge-noise silencer chamber 64, while the other end thereof opens into a valve-device housing chamber 202, thus communicating the discharge-noise silencer chamber 64 and the valve-device housing chamber 202 to each other.

This valve-device housing chamber 202 is formed vertically in such a configuration that an upper-part opening thereof toward the suction path 60 and a lower-part opening thereof toward the lower cover 68 are blocked by sealing agents 204 and 205 respectively.

Above a position where the first path 201 opens into the valve-device housing chamber 202, one end of a second path 203 opens into it and the other end thereof opens into the suction path 60, thus communicating the valve-device housing chamber 202 and the suction path 60 to each other. These first and second paths 201 and 203 and valve-device housing chamber 202 are formed in the lower-part support member 56, thus constituting the communication path 200. In this valve-device housing chamber 202 is there vertically movably housed a valve device 206 which functions as a release valve. On an upper face of this valve device is there provided a telescoping spring 207 in a condition where one end thereof butts against it and the other end thereof is fixed to the sealing agent 204, so that the valve device 206 is downward urged by the spring 207 always.

Furthermore, if the valve device 206 is placed between an opening position of the first path 201 and that of the second path 203 as shown in FIG. 9, a combination of a pressure in the suction path 60 (low pressure LP) and force of the spring 207 downward urges the valve device 206, whereas the medium pressure upward urges the valve device 206 through the first path 201. That is, the valve device 206 moves up and down in the valve-device housing chamber 202 owing to a pressure difference between a pressure of a low-pressure refrigerant gas on a refrigerant suction side plus urging force of the spring 207 and that of a medium-pressure refrigerant gas on a refrigerant discharge side.

Furthermore, by the present embodiment, if the pressure difference between a pressure of the low-pressure refrigerant gas and that of the medium-pressure refrigerant gas is 5 MPaG or less, the valve device 206 housed in the valve-device housing chamber 202 is put in a state shown in FIG. 9 in being positioned between the other end of the first path 201 and the second path 203 in the valve-device housing chamber 202, so that the refrigerant suction side and the refrigerant discharge side are not communicated to each other but blocked from each other by the valve device 206.

The urging force of the spring 207 is set so that if the medium pressure rises until the pressure difference between a pressure of the low-pressure refrigerant gas and that of the medium-pressure refrigerant gas increases up to 5 MPaG (upper limit value), the valve device 206 is raised above the second path 203 by the mediate-pressure refrigerant gas flowing through the first path 201 to communicate the first path 201 and the second path 203 to each other (open the communication path 200) in order to flow the medium-pressure refrigerant gas on the refrigerant discharge side into the suction path 60 on the refrigerant suction side. If the pressure difference between the two becomes less than 5 MPaG, on the other hand, the valve device 206 is lowered to a position between a communication position of the first path 201 below the second path 203 and a communication position of the second path 203 to block the first path 201 and the second path 203 from each other, thus closing the communication path 200. In such a manner, it is possible to regulate below the upper limit value a first-stage differential pressure, that is, a pressure difference between the refrigerant discharge side and the refrigerant suction side of the first rotary compression element 32.

Figure 10:
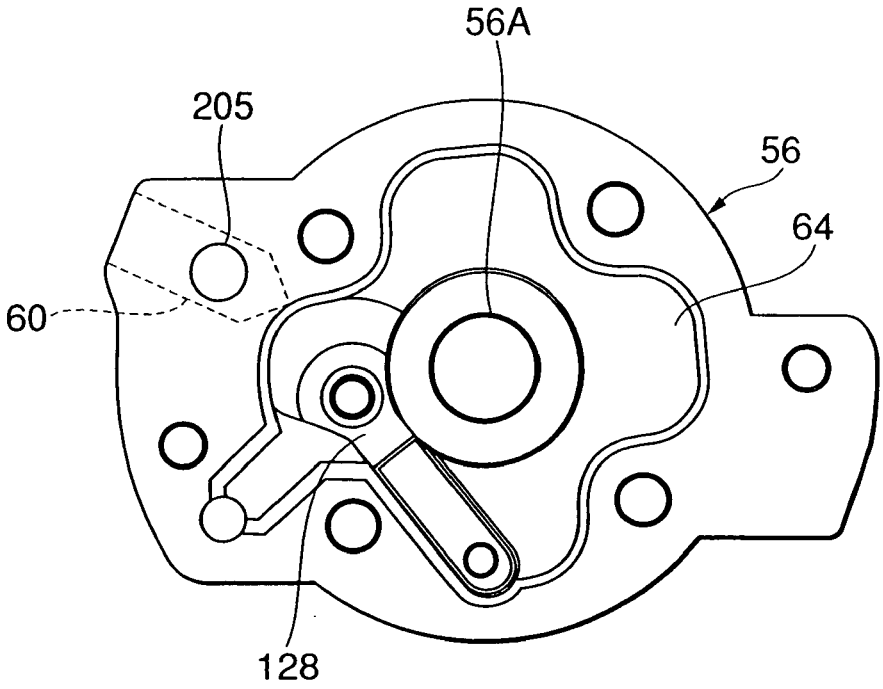
FIG. 10 is a bottom view for showing a lower-part support member of the multi-stage compression type rotary compressor of FIG. 8.

The lower cover 68, on the other hand, is made of a donut-shaped circular steel plate and fixed upward to the lower-part support member 56 by main bolts 129 disposed peripherally, to block a lower-part opening of the discharge-noise silencer chamber 64 communicating with an inside of the lower cylinder 40 of the first rotary compression element 32 through the discharge port 41. Tips of these main bolts 129 are screwed to the upper-part support member 54. FIG. 10 shows a bottom of the lower-part support member, in which a reference numeral 128 indicates a discharge valve of the first rotary compression element 32 for opening and closing the discharge port 41 in the discharge-noise silencer chamber 64.

Further, the discharge-noise silencer chamber 64 and a face of the upper cover 66 on a side of the electrical-power element 14 in the sealed vessel 12 are communicated to each other through a communication path, not shown, which penetrates the upper and lower cylinders 38 and 40 and the intermediate partition plate 36. In this case, at an upper end of the communication path is there provided the intermediate discharge pipe 121 as erected, through which a medium-pressure refrigerant is discharged into the sealed vessel 12.

Figure 11:
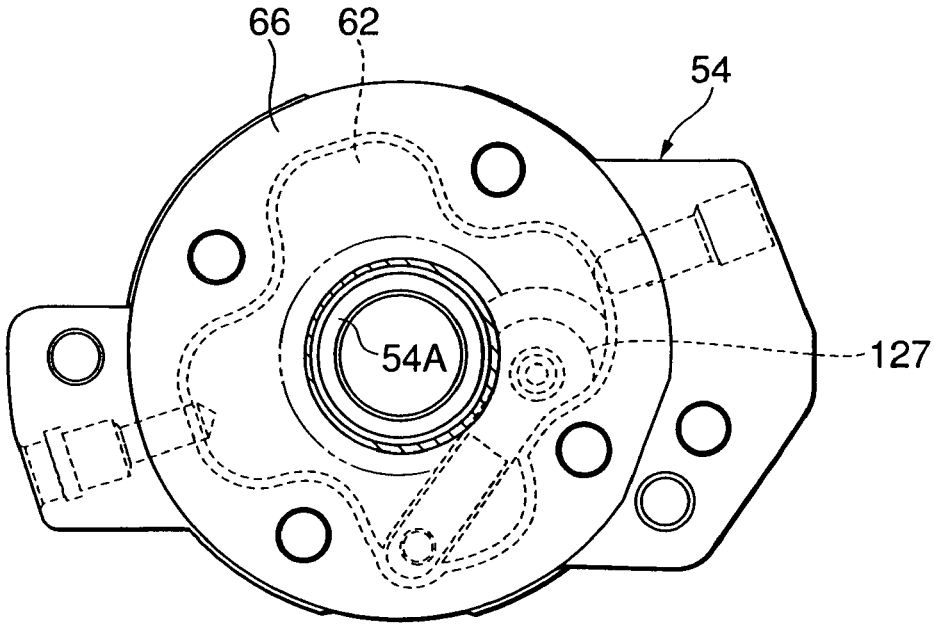
FIG. 11 is a top view for showing an upper-part support member of the multi-stage compression type rotary compressor of FIG. 8.

Furthermore, the upper cover 66 blocks an upper-face opening of the discharge-noise silencer chamber 62 communicating with an inside of the upper cylinder 38 of the second rotary compression element 34 through a discharge port 39, thus partitioning an inside of the sealed vessel 12 into the discharge-noise silencer chamber 62 and a side of the electrical-power element 14. As shown in FIG. 11, this upper cover 66 is made of a roughly donut-shaped circular steel plate in which a hole is formed through which the bearing 54A for the upper-part support member 54 extends through and fixed downward to the upper-part support member 54 by main bolts 78 peripherally. Tips of these main bolts 78 are screwed to the lower-part support member 56. It is to be noted that a reference numeral 127 in FIG. 11 indicates a discharge valve of the second rotary compression element 34 for opening and closing the discharge port 39 in the discharge-noise silencer chamber 62.

It is to be noted that discharge valves 127 and 128 are made of an elastic member such as a vertically long metal plate, one sides of which valves 127 and 128 butt against the discharge ports 39 and 41 respectively in close contact therewith and the other sides of which are fixed by screws, not shown, in screw holes, not shown, formed somewhere distant from the discharge ports 39 and 41 by a predetermined spacing. The discharge valves 127 and 128 butt against the discharge ports 39 and 41 with constant urging force to open and close the discharge ports 39 and 41 by elasticity respectively.

In FIG. 8, a reference numeral 94 indicates a suction pipe of the first rotary compression element 32, which suction pipe is attached and communicated to the suction path 60 of the lower-part support member 56. Reference numerals 92 and 96 indicate a suction pipe and a discharge pipe of the second rotary compression element 34, one end of which suction pipe 92 communicates to an inside of the sealed vessel 12 above the upper cover 66 and the other end of which communicates with the suction path 58 of the second rotary compression element 34. The discharge pipe 96 is attached and communicated to the discharge-noise silencer chamber 62 of the second rotary compression element 34.

In this case, as a refrigerant, carbon dioxide ($CO_2$) which is a natural refrigerant friendly to environments of the earth is used taking into account inflammability, toxicity, etc., while as a lubricant, such existing oil is used as mineral oil, alkyl-benzene oil, ether oil, or ester oil.

The following will describe operations with reference to this configuration. When the stator coil 28 of the electrical-power element 14 is electrified through the terminal 20 and a wiring line not shown, the electrical-power element 14 is actuated, thus causing the rotor 24 to revolve. By this revolution, the upper and lower rollers 46 and 48 are fitted to the upper and lower eccentric portions 42 and 44 provided integrally with the rotary shaft 16, to eccentrically revolve in the upper and lower cylinders 38 and 40 respectively.

Figure 12:
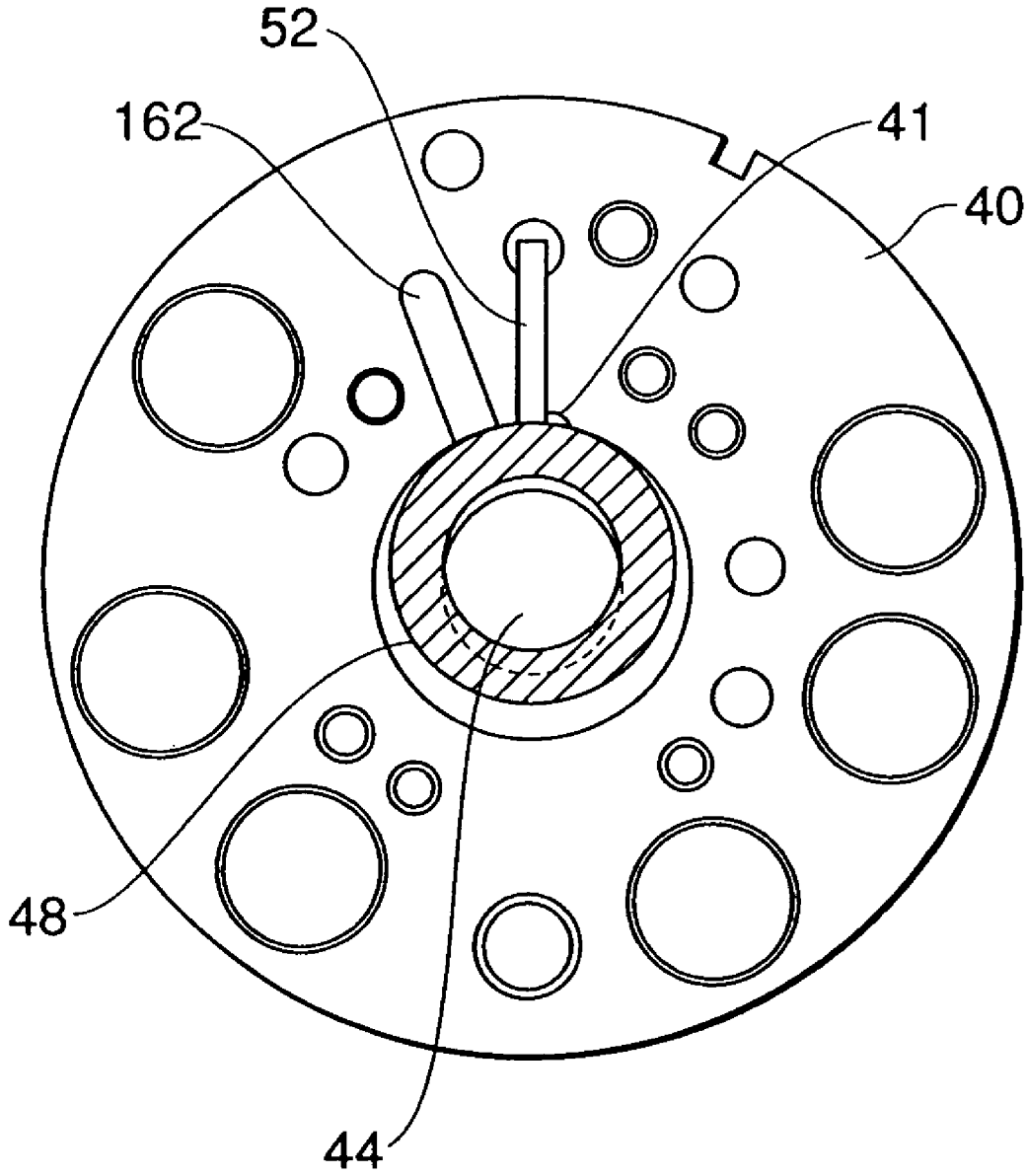
FIG. 12 is a bottom view for showing a lower cylinder of the multi-stage compression type rotary compressor of FIG. 8.

Accordingly, a low-pressure (LP) refrigerant sucked into the low-pressure chamber side of the lower cylinder 40 from the suction port 162 shown in FIG. 12 illustrating a bottom of the lower cylinder 40 through the suction pipe 94 and the suction path 60 formed in the lower-part support member 56 is compressed by operations of the lower roller 48 and the lower vane 52 to have a medium pressure (MP), passed through the high-pressure chamber side of the lower cylinder 40 and the discharge port 41, and discharged into the discharge-noise silencer chamber 64 formed in the lower-part support member 56.

At this moment, if a pressure difference of the refrigerant gas between a pressure of a refrigerant gas in the suction path 60 on a refrigerant suction side and that in the discharge-noise silencer chamber 64 on a refrigerant discharge side is less than 5 MPaG, the valve device 206 is positioned between the communication position of the first path 201 and that of the second path 203 in the valve device housing chamber 202, so that the communication path 200 is blocked. Then, a medium-pressure refrigerant gas discharged into the discharge-noise silencer chamber 64 passes through a communication path not shown and is discharged into the sealed vessel 12 from the intermediate discharge pipe 121. Accordingly, the sealed vessel 12 has the medium pressure therein.

In this case, for example, if an outside air temperature rises to increase an evaporation temperature of a later-described evaporator and thereby increase the medium pressure until the pressure difference of the refrigerant gas between a pressure of the refrigerant gas in suction path 60 on a low pressure side and that in the discharge-noise silencer chamber 64 on a medium pressure side reaches the upper limit value of 5 MPaG, this increased medium pressure causes the valve device 206 to be pressed upward above the communication position of the second path 203 in the valve device housing chamber 202, so that the first path 201 and the second path 203 communicate with each other, thus flowing the medium-pressure refrigerant gas into the suction path 60 on the lower pressure side. When the medium-pressure refrigerant is thus discharged to the suction side to thereby reduce the pressure difference between the two below 5 MPaG, the valve device 206 returns downward to a position below the communication position of the second path 203, so that the communication path 200 (first path 201, valve device housing chamber 202, and second path 203) is closed by the valve device 206.

Figure 13:
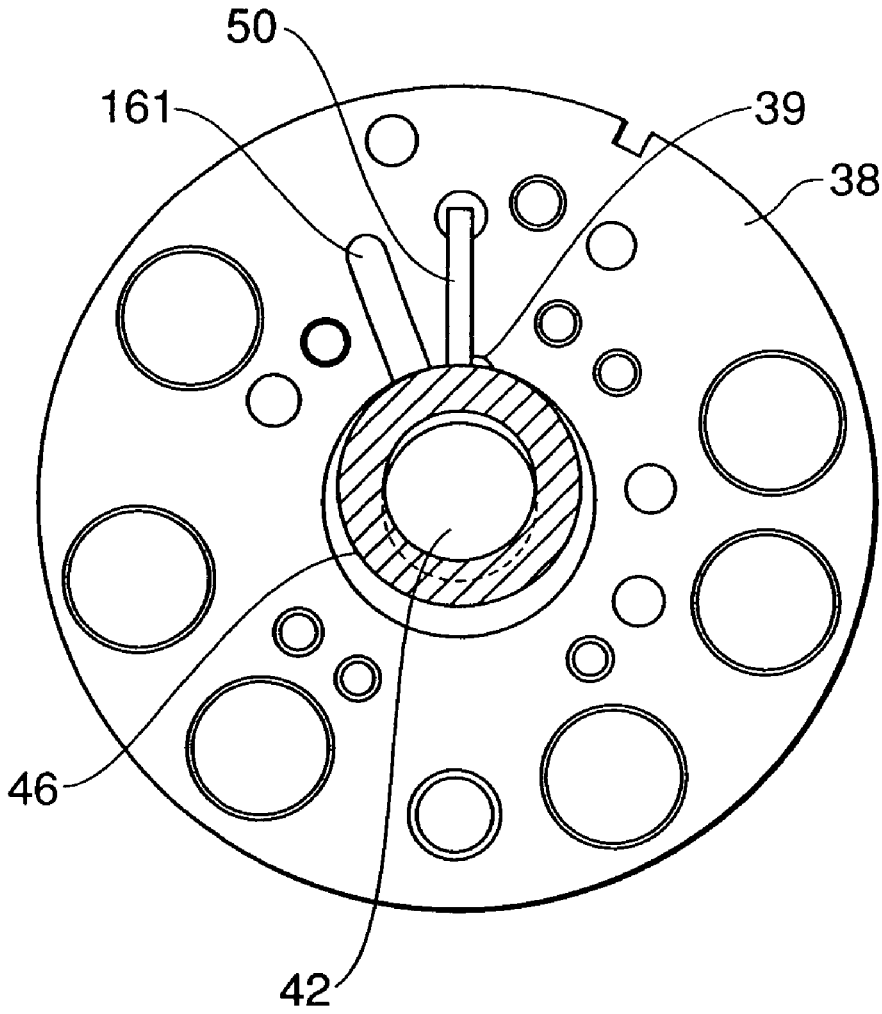
FIG. 13 is a top view for showing an upper cylinder of the multi-stage compression type rotary compressor of FIG. 8.

Then, the medium-pressure refrigerant gas in the sealed vessel 12 exits it and passes through the suction pipe 92, enters the suction path 58 formed in the upper-part support member 54, and is sucked therethrough into a low-pressure chamber side of the upper cylinder 38 from the suction port 161 shown in FIG. 13 illustrating a top of the upper cylinder 38. The medium-pressure refrigerant gas thus sucked undergoes second-stage compression through operations of the upper roller 46 and the upper vane 50 to provide a high-temperature, high-pressure refrigerant gas (HP), which passes from a high-pressure chamber side through the discharge port 39 and is sucked from the discharge-noise silencer chamber 62 formed in the upper-part support member 54 and through the discharge pipe 96 into the gas cooler 154 shown in FIG. 4 provided outside the multi-stage compression type rotary compressor 10. Then, it flows from the gas cooler 154 into the expansion valve 156 and the evaporator 157 sequentially.

Thus, in the multi-stage compression type rotary compressor 10 comprising the electrical-power element 14 and the first and second rotary compression elements 32 and 34 driven by the electrical-power element 14 in the sealed vessel 12 in such a configuration that a refrigerant gas compressed at the first rotary compression element 32 and discharged therefrom is sucked into the second rotary compression element 34 to be compressed and discharged therefrom, there are provided the communication path 200 which communicates a refrigerant suction side and a refrigerant discharge side of the first rotary compression element 32 to each other and the valve device 206 which opens and closes the communication path 200 in such a manner as to open it if a pressure difference between the refrigerant suction side and the refrigerant discharge side of the first rotary compression element 32 exceeds a predetermined upper limit value (5 MPaG), so that it is possible to suppress a first-stage differential pressure down to the upper limit value or less. Accordingly, it is possible to suppress a pressure difference between an inside and an outside of the discharge valve 127 of the first rotary compression type element 32 down to the upper limit value or less, thus avoiding a trouble that the discharge valve 127 may be damaged by the pressure difference.

Furthermore, by the present embodiment, the suction path 60 and the discharge-noise silencer chamber 64 arranged in the lower-part support member 56 which blocks an opening face of the lower cylinder 40 constituting the first rotary compression element 32 and also which has a bearing for the rotary shaft 16 of the electrical-power element 14 are communicated to each other through the communication path 200 formed in the lower-part support member 56 and the valve device 206 is also provided in the lower-part support member 56, so that the communication path 200 and the valve device 206 can be integrated into the lower-part support member 56 to realize miniaturization. Furthermore, it is possible to form the communication path 200 in the lower-part support member 56 beforehand to attach and set the valve device 206 thereto, thus improving a work efficiency in assembly of the multi-stage compression type rotary compressor 10.

It is to be noted that although the present embodiment has been described in all cases with reference to the multi-stage compression type rotary compressor 10 in which the rotary shaft 16 is mounted vertically, of course the present invention can be applied also to a multi-stage compression type rotary compressor in which the rotary shaft is mounted horizontally. Furthermore, the upper limit of the first-stage differential pressure given in the present embodiment is not restricted to the above-mentioned value and so may be set appropriately corresponding to a capacity and an employed pressure of the rotary compressor.

Furthermore, the multi-stage compression type rotary compressor has been described as a two-stage compression type rotary compressor equipped with first and second rotary compression elements, the present invention is not limited thereto; for example, the multi-stage compression type rotary compressor may be equipped with three, four, or even more stages of rotary compression elements.

As detailed above, according to the present embodiment of the present invention, in a multi-stage compression type rotary compressor comprising an electrical-power element and first and second rotary compression elements driven by this electrical-power element in a sealed vessel in such a configuration that a refrigerant gas compressed in the first rotary compression element and discharged therefrom is sucked into the second rotary compression element to be compressed and discharged therefrom, there are provided a communication path which communicates a refrigerant suction side and a refrigerant discharge side of the first rotary compression element to each other and a valve device which opens and closes this communication path in such a manner as to open it if a pressure difference between the refrigerant suction side and the refrigerant discharge side of the first rotary compression element exceeds a predetermined upper limit value, so that it is possible to suppress the pressure difference between the refrigerant suction side and the refrigerant discharge side of the first rotary compression element which is the first-stage differential pressure down to the predetermined upper limit value or less. Accordingly, it is possible to avoid a trouble such as damaging of the discharge valve provided on the first rotary compression element caused by an excessive value of the first-stage differential pressure, thus improving durability and reliability of the rotary compressor.

Furthermore, by the present invention, there are provided a cylinder constituting the first rotary compression element, a support member which blocks an opening face of this cylinder and also which has a bearing for the rotary shaft of the electrical-power element, and a suction path and a discharge-noise silencer chamber which are arranged in this support member in such a configuration that the communication path is formed in the support member to communicate the suction path and the discharge-noise silencer chamber to each other and also the valve device is provided in the support member, so that the communication path and the valve device can be integrated into the cylinder of the first rotary compression element to realize miniaturization and also the valve device can be set into the cylinder beforehand, thus improving a work efficiency in assembly.

Figure 14:
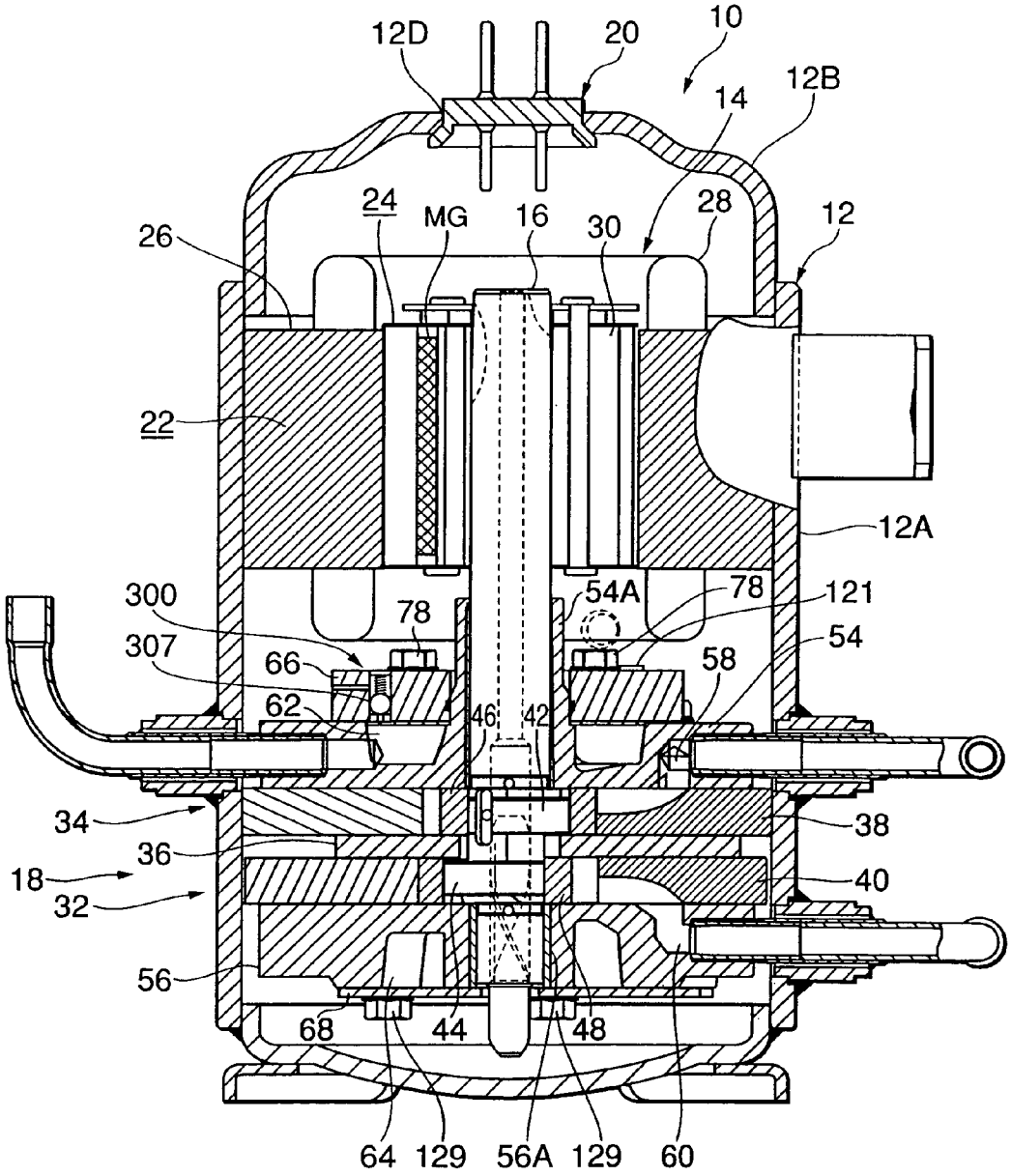
FIG. 14 is a vertical cross-sectional view for showing a multi-stage compression type rotary compressor according to a still further embodiment of the present invention.

The following will describe a multi-stage compression type rotary compressor according to a still further embodiment of the present invention with reference to FIGS. 14–17. FIG. 14 shows a vertical cross-sectional view of the multi-stage compression type rotary compressor according to the present embodiment. It is to be noted that the same reference numerals in these figures as those in FIGS. 1–3 have the same or similar functions.

In FIG. 14, a reference numeral 10 indicates an internal medium-pressure, multi-stage compression type rotary compressor using carbon dioxide as a refrigerant which comprises the sealed vessel 12 composed of the cylindrical vessel body 12A made of a steel plate and the roughly cup-shaped end cap (lid body) 12B which blocks an upper-part opening of this vessel body 12A and the rotary compression mechanism portion 18 which includes the electrical-power element 14 arranged and housed in an upper part of an internal space of the vessel body 12A of the sealed vessel 12 and the first rotary compression element 32 (first stage) and the second rotary compression element 34 (second stage) which are arranged below this electrical-power element 14 to be driven by the rotary shaft 16 of the electrical-power element 14. It is to be noted that the sealed vessel 12 has its bottom used as an oil reservoir. Furthermore, the end cap 12B has the circular attachment hole 12D formed therein at a center of its top face, in which attachment hole 12D the terminal 20 (wiring of which is omitted) is attached for supplying power to the electrical-power element 14.

The electrical-power element 14 is composed of the stator 22 mounted annularly along an inner peripheral face of an upper space of the sealed vessel 12 and the rotor 24 disposed and inserted in the stator 22 with some gap set therebetween. To this rotor 24, the rotary shaft 16 which vertically extends is fixed.

The stator 22 has the stack 26 formed by stacking donut-shaped electromagnetic steel plates and the stator coil 28 wound round teeth of the stack 26 by direct winding (concentrated winding). Furthermore, similar to the stator 22, the rotor 24 is also made of the stack 30 of electromagnetic steel plates and the permanent magnet MG inserted into the stack 30.

The intermediate partition plate 36 is sandwiched between the first rotary compression element 32 and the second rotary compression element 34. That is, a combination of the first rotary compression element 32 and the second rotary compression element 34 is composed of the intermediate partition plate 36, the cylinders 38 and 40 arranged above and below the intermediate partition plate 36 respectively, the upper and lower rollers 46 and 48 which are fitted to the upper and lower eccentric portions 42 and 44 provided on the rotary shaft 16 with a phase difference of 180 degrees therebetween to thereby eccentrically revolve within the upper and lower cylinders 38 and 40 respectively, the upper and lower vanes 50 and 52 which butt against these upper and lower rollers 46 and 48 to divide an inside of the respective upper and lower cylinders 38 and 40 into a low-pressure chamber side and a high-pressure chamber side, and the upper-part support member 54 and the lower-part support member 56 given as a support member for blocking an upper-side opening face of the upper cylinder 38 and a lower-side opening face of the lower cylinder 40 respectively to serve also as a bearing for the rotary shaft 16.

Furthermore, as shown in FIGS. 11–13 and FIG. 17, a combination of the upper-part support member 54 and the lower-part support member 56 is provided therein with the suction paths 58 and 60 which communicate with insides of the upper and lower cylinders 38 and 40 through the suction ports 161 and 162 respectively and the discharge muffler chambers 62 and 64 formed by blocking concavities in the upper-part support member 54 and the lower-part support member 56 by covers serving as a wall respectively. That is, the discharge muffler chamber 62 is blocked by the upper cover 66 serving as a wall defining the discharge muffler chamber 62 and the discharge muffler chamber 64, by the lower cover 68 serving as a wall defining the discharge muffler chamber 64.

In this case, the bearing 54A is formed as erected at a center of the upper-part support member 54. At a center of the lower-part support member 56 is there formed the bearing 56A as going through, so that the rotary shaft 16 is held by the bearing 54A of the upper-part support member 54 and the bearing 56A of the lower-part support member 56.

Figure 17:
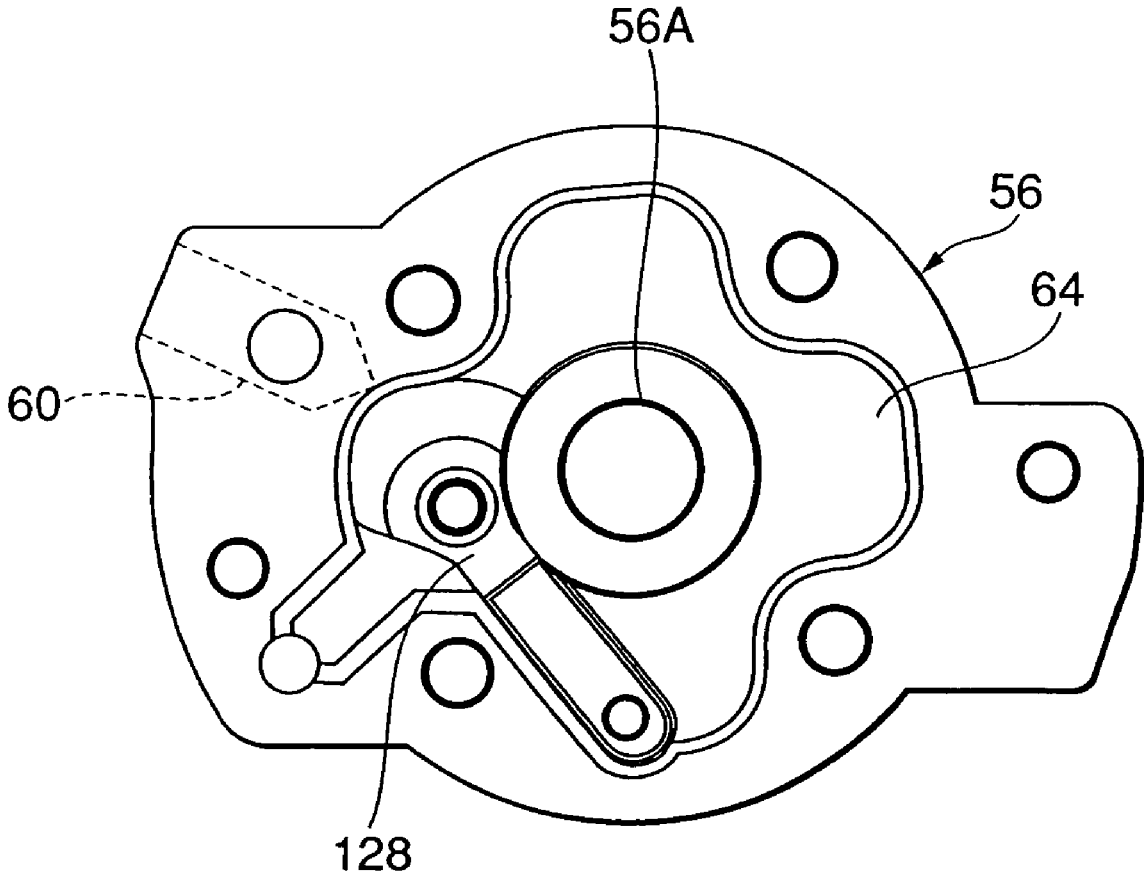
FIG. 17 is a bottom view for showing a lower-part support member of the multi-stage compression type rotary compressor of FIG. 14.

Furthermore, the lower cover 68 is made of a donut-shaped circular steel plate to define the discharge-noise silencer chamber 64 communicating with an inside of the lower cylinder 40 of the first rotary compression element 32, and it is fixed upward to the lower-part support member 56 by the main bolts 129 disposed peripherally, tips of which are screwed to the upper-part support member 54. FIG. 17 shows a bottom of the lower-part support member 56, in which a reference numeral 128 indicates the discharge valve of the first rotary compression element 32 for opening and closing the discharge port 41 in the discharge-noise silencer chamber 64.

Further, the discharge-noise silencer chamber 64 of the first rotary compression element 32 and the inside of the sealed vessel 12 communicate with each other through an communication path, which is a hole, not shown, penetrating the upper cover 66, the upper and lower cylinders 38 and 40, and the intermediate partition plate 36. In this case, at an upper end of the communication path is there provided the intermediate discharge pipe 121 as erected, through which a medium-pressure refrigerant is discharged into the sealed vessel 12.

Furthermore, the upper cover 66 defines the discharge-noise silencer chamber 62 communicating through the discharge port 39 with an inside of the upper cylinder 38 of the second rotary compression element 34, above which upper cover 66 is there provided the electrical-power element 14 with a predetermined spacing present therebetween. Similarly, as described with reference to FIG. 11, this upper cover 66 is made of a roughly donut-shaped circular steel plate in which a hole is formed through which the bearing 54A for the upper-part support member 54 extends through and fixed by the main bolts 78 peripherally. Therefore, tips of these main bolts 78 are screwed to the lower-part support member 56.

It is to be noted that the discharge valves 127 and 128 are constituted of an elastic member made of a vertically long rectangular metal plate, one sides of which valves 127 and 128 butt against the discharge ports 39 and 41 respectively to seal them and the other sides of which are fixed by screws, not shown, provided somewhere distant from the discharge ports 39 and 41 by a predetermined spacing therebetween. The discharge valves 127 and 128 butt against the discharge ports 39 and 41 with constant urging force to open and close the discharge ports 39 and 41 by elasticity respectively.

Figure 15:
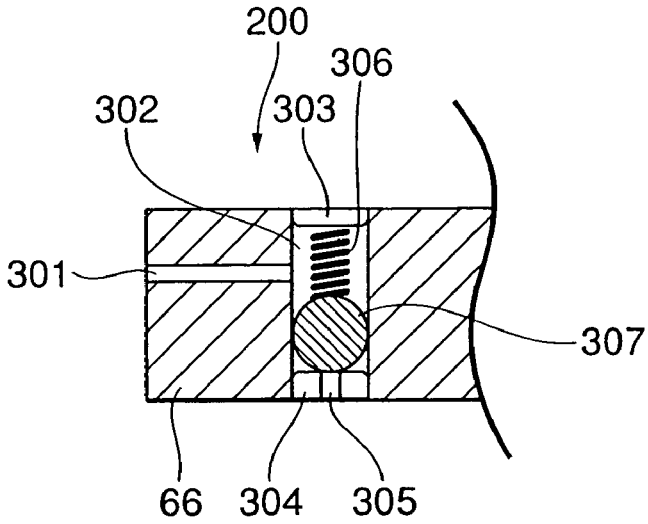
FIG. 15 is an expanded cross-sectional view for showing a communication path of a second rotary compression element of the multi-stage compression type rotary compressor of FIG. 14.

Furthermore, in the upper cover 66 of the second rotary compression element 34 is there provided a communication path 300 according to the present embodiment of the present invention. This communication path 300 communicates, to each other, the inside of the sealed vessel 12 which provides a path through which a medium-pressure refrigerant gas compressed at the first rotary compression element 32 and the discharge-noise silencer chamber 62 on a refrigerant discharge side of the second rotary compression element, in such a configuration that, as shown in FIG. 15, one end of a horizontally extending first path 301 communicates with the inside of the sealed vessel 12 and the other end of the first path 301 communicates with a valve device housing chamber 302. This valve device housing chamber 302 is a hole penetrating the upper cover 66 vertically in such a configuration that an upper face thereof opens into the sealed vessel 12 and a lower face thereof opens into the discharge-noise silencer chamber 62. Furthermore, upper and lower openings of this valve device housing chamber 302 are blocked by sealing agents 303 and 304 respectively.

In the sealing agent 304 provided at a bottom of the valve device housing chamber 302 is there formed a second path 305 which communicates the valve device housing chamber 302 and the discharge-noise silencer chamber 62 to each other. These first path 301, valve device housing chamber 302, and second path 305 are combined to constitute the communication path 300. Furthermore, in the valve device housing chamber 302 of this communication path 300 is there housed a spherical valve device 307, a top face of which is abutted by one end of a telescoping spring 306 (urging member). The other end of this spring 306 is fixed at the upper side sealing agent 303, so that the valve device 307 is always downward urged by this spring 306 to thereby block the second path 305 always.

Furthermore, in construction, a medium pressure refrigerant in the sealed vessel 12 flows through the first path 301 into the valve device housing chamber 302 to downward urge the valve device 307, while a high pressure refrigerant in the discharge-noise silencer chamber 62 flows through the second path 305 formed in the lower side sealing agent 304 into the valve device housing chamber 302 to upward urge the valve device 307 at its bottom.

Thus, the valve device 307 is downward urged by the medium pressure refrigerant gas and the spring 306 from a side where the spring 306 butts against, that is, from the above and, from an opposite side, upward urged by the high pressure refrigerant gas. Therefore, the bottom of the valve device 307 always butts against the second path 305 to be sealed, so that the communication path 300 is blocked by the valve device 307 always.

It is to be noted that the urging force of the spring 306 is supposed to be set so that when a pressure difference between a pressure of a medium pressure refrigerant gas in the sealed vessel 12 and that of a high pressure refrigerant gas in the discharge-noise silencer chamber 62 has reached an upper limit value of, for example, 8 MPaG, the valve device 307 abutted against the first path 305 to close it may be pressed upward by the high pressure refrigerant gas flowing in through the second path 305. Therefore, if this pressure difference exceeds 8 MPaG (upper limit value), the first path 301 and the second path 305 communicate with each other through the valve device housing chamber 302, so that the high pressure refrigerant gas in the discharge-noise silencer chamber 62 flows into the sealed vessel 12. If this pressure difference is reduced below 8 MPaG, on the other hand, the spring 306 abuts the valve device 307 against the second path 305 to close it, so that the valve device 307 blocks the first path 301 and the second path 305 from each other. Thus, a second-stage differential pressure can be prevented beforehand from becoming excess.

As described above, as a refrigerant, carbon dioxide ($CO_2$) which is a natural refrigerant friendly to environments of the earth is used taking into account inflammability, toxicity, etc., while as a lubricant, such existing oil is used as mineral oil, alkyl-benzene oil, ether oil, or ester oil.

The following will describe operations with reference to this configuration. When the stator coil 28 of the electrical-power element 14 is electrified through the terminal 20 and a wiring line not shown, the electrical-power element 14 is actuated, thus causing the rotor 24 to revolve. By this revolution, the upper and lower rollers 46 and 48 are fitted to the upper and lower eccentric portions 42 and 44 provided integrally with the rotary shaft 16, to eccentrically revolve in the upper and lower cylinders 38 and 40 respectively.

Accordingly, a low-pressure refrigerant sucked into the low-pressure chamber side of the lower cylinder 40 from the suction port 162 through the suction path 60 formed in the lower-part support member 56 as shown in FIG. 11 is compressed by operations of the lower roller 48 and the lower vane 52 to have a medium pressure, passed through the high-pressure chamber side of the lower cylinder, and the discharge port 41, the discharge-noise silencer chamber 64 formed in the lower-part support member 56, and a communication path not shown, and is discharged into the sealed vessel 12 from the intermediate discharge pipe 121.

Then, the medium-pressure refrigerant gas in the sealed vessel 12 passes through a refrigerant path not shown and the suction path 58 formed in the upper-part support member 54, and is sucked into the low-pressure chamber side of the upper cylinder 38 from the suction port 161 shown in FIG. 13. The medium-pressure refrigerant gas thus sucked undergoes second-stage compression through operations of the upper roller 46 and the upper vane 50 to provide a high-temperature, high-pressure refrigerant gas, which passes from the high-pressure chamber side through the discharge port 39 and is sucked into the discharge-noise silencer chamber 62 formed in the upper-part support member 54.

If, a this moment, a pressure difference between a pressure of the medium pressure refrigerant gas in the sealed vessel 12 and that of the high pressure refrigerant gas in the discharge-noise silencer chamber 62 is less than 8 MPaG, as mentioned above, the valve device 307 is abutted against the second path 305 to close it in the valve-device housing chamber 302, so that the communication path 300 is not opened and, therefore, the high pressure refrigerant gas discharged into the discharge-noise silencer chamber 62 all flows through a refrigerant path not shown into the gas cooler 154 (FIG. 4) provided outside the multi-stage compression type rotary compressor 10.

After flowing into the gas cooler 154, the refrigerant radiates heat to exert a heating action. After exiting the gas cooler 154, the refrigerant is decompressed at the expansion valve 156 and enters the evaporator 157 to evaporate there. Finally, the refrigerant is sucked to the suction path 60 of the first rotary compression element 32, which cycle is repeated.

It is to be noted that if an outside air temperature drops to reduce an evaporation temperature of the refrigerant in the evaporator, as described above, it is difficult also for a pressure (medium pressure) of a refrigerant discharged from the first rotary compression element 32 into the sealed vessel 12 to rise. Thus, when a pressure difference between a pressure of a medium pressure refrigerant gas in the sealed vessel 12 and that of a high pressure refrigerant gas in the discharge-noise silencer chamber 62 has reached 8 MPaG, the valve device 307 abutted against the second path 305 by a pressure in the discharge-noise silencer chamber 62 is pressed upward against the spring 306 to be released from the second path 305, so that the first path 301 and the second path 305 communicate with each other to flow the high pressure refrigerant gas into the sealed vessel 12 on a medium pressure side. If the pressure difference between the two drops below 8 MPaG, on the other hand, the valve device 307 butts against the second path 305 to close it, thus blocking the second path 305.

As described above, in the present embodiment comprising the electrical-power element 14 and the first and second rotary compression elements 32 and 34 driven by this electrical-power element 14 in the sealed vessel 12 in such a configuration that a medium pressure refrigerant gas compressed at the first rotary compression element 32 is sucked into the second rotary compression element 34 to be compressed and discharged therefrom, there are provided the communication path 300 which communicates a passage for the medium pressure refrigerant compressed at the first rotary compression element 32 and a refrigerant discharge side of the second rotary compression-element 34 to each other and the valve device which opens and closes this communication path 300, wherein a pressure difference between a pressure of the medium pressure refrigerant gas and that of a refrigerant gas on a refrigerant discharge side of the second rotary compression element 34 exceeds a predetermined upper limit value of 8 MPaG, the valve device 307 opens the communication path 307, so that it is possible to suppress a second-stage differential pressure below the upper limit value, thus avoiding damaging of the discharge valve 128 of the second rotary compression element 34 beforehand.

Furthermore, there are also provided the upper cylinder 38 constituting the second rotary compression element 34, the discharge-noise silencer chamber 62 into which a refrigerant gas compressed in this upper cylinder 38 is discharged, and the upper cover 66 serving as a wall defining this discharge-noise silencer chamber 62 in such a configuration that the communication path 300 is formed in the upper cover 66 to communicate an inside of the sealed vessel 12 and the discharge-noise silencer chamber 62 to each other and also the valve device 307 is provided in the upper cover 66, so that it is possible to suppress the second-stage differential pressure without complicating a construction of the communication path 300.

Although the present embodiment has been described in all cases with reference to the multi-stage compression type rotary compressor 10 in which the rotary shaft 16 is mounted vertically, of course the present invention can be applied also to a multi-stage compression type rotary compressor in which the rotary shaft is mounted horizontally.

Furthermore, the multi-stage compression type rotary compressor has been described as a two-stage compression type rotary compressor equipped with first and second rotary compression elements, the present invention is not limited thereto; for example, the multi-stage compression type rotary compressor may be equipped with three, four, or even more stages of rotary compression elements.

Figure 16:
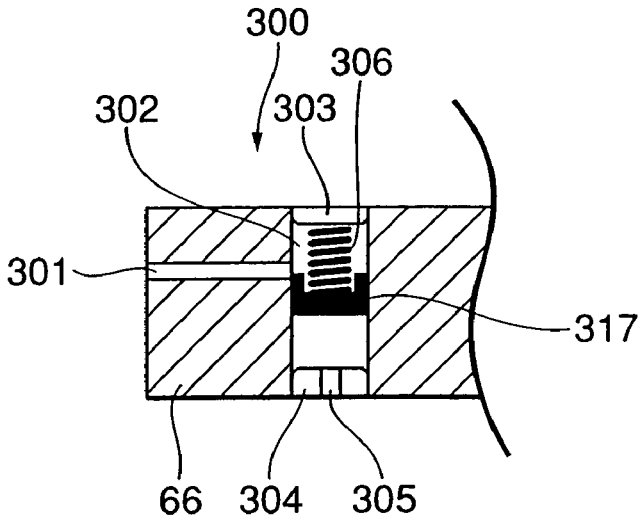
FIG. 16 is an expanded cross-sectional view for showing the communication path of the second rotary compression element of another multi-stage compression type rotary compressor which corresponds to FIG. 15.

It is to be noted that although the present embodiment has employed a spherical valve device 307, the present invention is not limited thereto; for example, a cylindrical valve device 317 such as shown in FIG. 16 may be employed. In this case, the valve device 317 is arranged to butts against a wall face of the valve-device housing chamber 302 to seal it in such a configuration that it is ordinarily placed in the valve-device housing chamber 302 between the first path 301 and the second path 305 to thereby block the communication path 300. In this configuration, if the pressure difference exceeds 8 MPaG, the valve device 317 is pressed upward above the first path 301 to thereby communicate the first path 301 and the second path 305 to each other, thus flowing a high pressure refrigerant gas into the sealed vessel 12 having a medium pressure. If the pressure difference between the two drops below 8 MPaG, the valve device 317 returns back below the first path 301, thus blocking the first path 301 and the second path 305 from each other.

As detailed above, according to the present embodiment of the present invention, in a multi-stage compression type rotary compressor comprising an electrical-power element and first and second rotary compression elements driven by this electrical-power element in a sealed vessel in such a configuration that a medium pressure refrigerant gas compressed at the first rotary compression element is sucked into the second rotary compression element to be compressed and discharged therefrom, there are provided a communication path which communicates a passage for the medium pressure refrigerant compressed at the first rotary compression element and a refrigerant discharge side of the second rotary compression element to each other and a valve device which opens and closes this communication path in such a manner as to open it if a pressure difference between a pressure of the medium pressure refrigerant gas and that of a refrigerant gas on the refrigerant discharge side of the second rotary compression element exceeds a predetermined upper limit value, so that it is possible to suppress a pressure difference between a discharge pressure and a suction pressure of the second rotary compression element, that is, a second-stage differential pressure, below the predetermined upper limit value.

Accordingly, it is possible to avoid an occurrence of a trouble such as damaging of the discharge valve of the second rotary compression element.

Furthermore, there are provided also a cylinder which constitutes the second rotary compression element and a discharge-noise silencer chamber which discharges a refrigerant gas compressed in this cylinder in such a configuration that a medium pressure refrigerant gas compressed at the first rotary compression element is discharged into the sealed vessel and then sucked into the second rotary compression element, the communication path is formed in a wall defining the discharge-noise silencer chamber to communicate an inside of the sealed vessel and the discharge-noise silencer chamber to each other, and the valve device is provided in the wall, so that it is possible to integrate the communication path which communicates the passage for the medium pressure refrigerant compressed at the first rotary compression element and the refrigerant discharge side of the second rotary compression element to each other and the valve device which opens and closes the communication path into a wall of the second rotary compression element.

Accordingly, it is possible to simplify a construction and reduce overall size.

Figure 18:
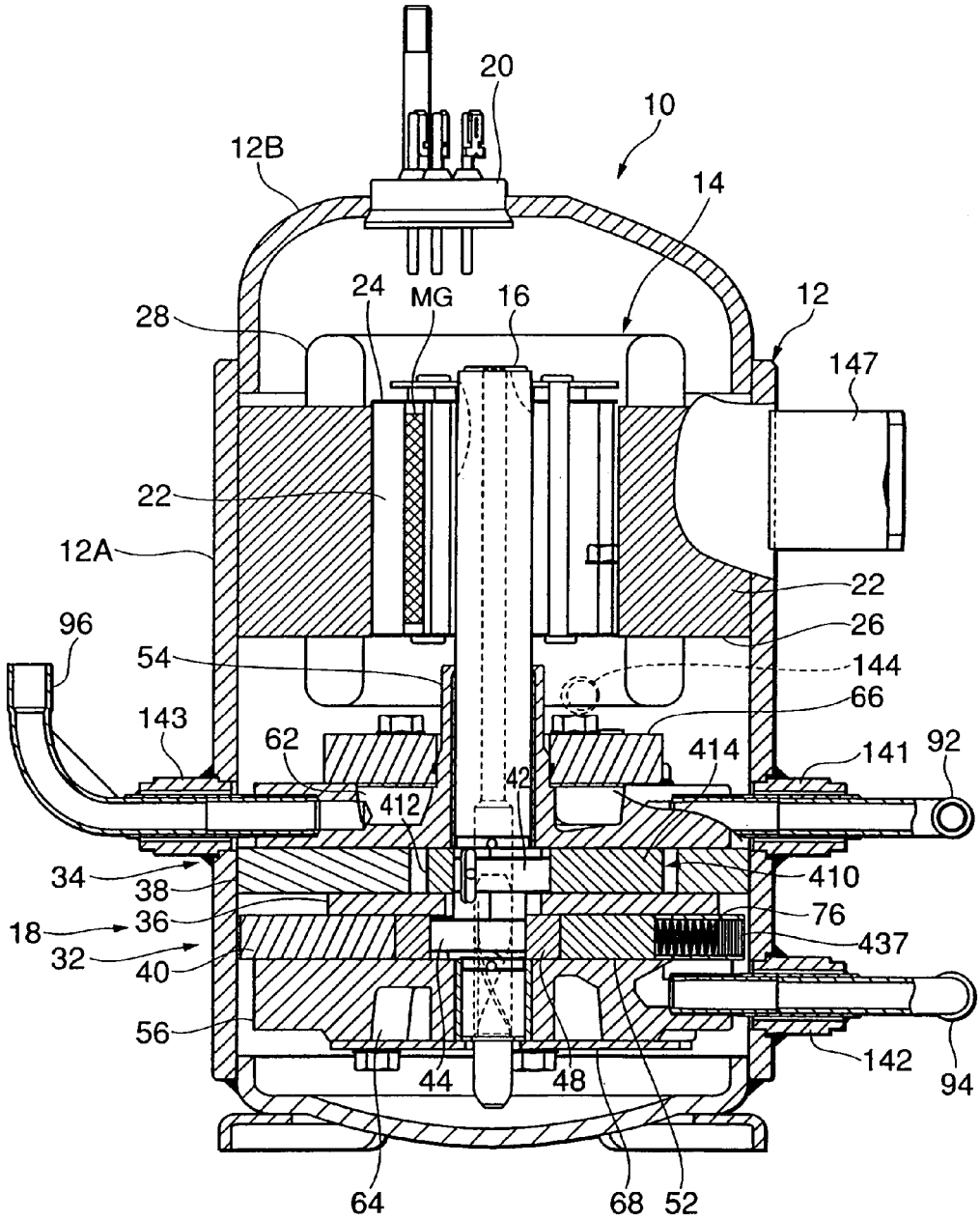
FIG. 18 is a vertical cross-sectional view for showing a rotary compressor according to an additional embodiment of the present invention.
Figure 19:
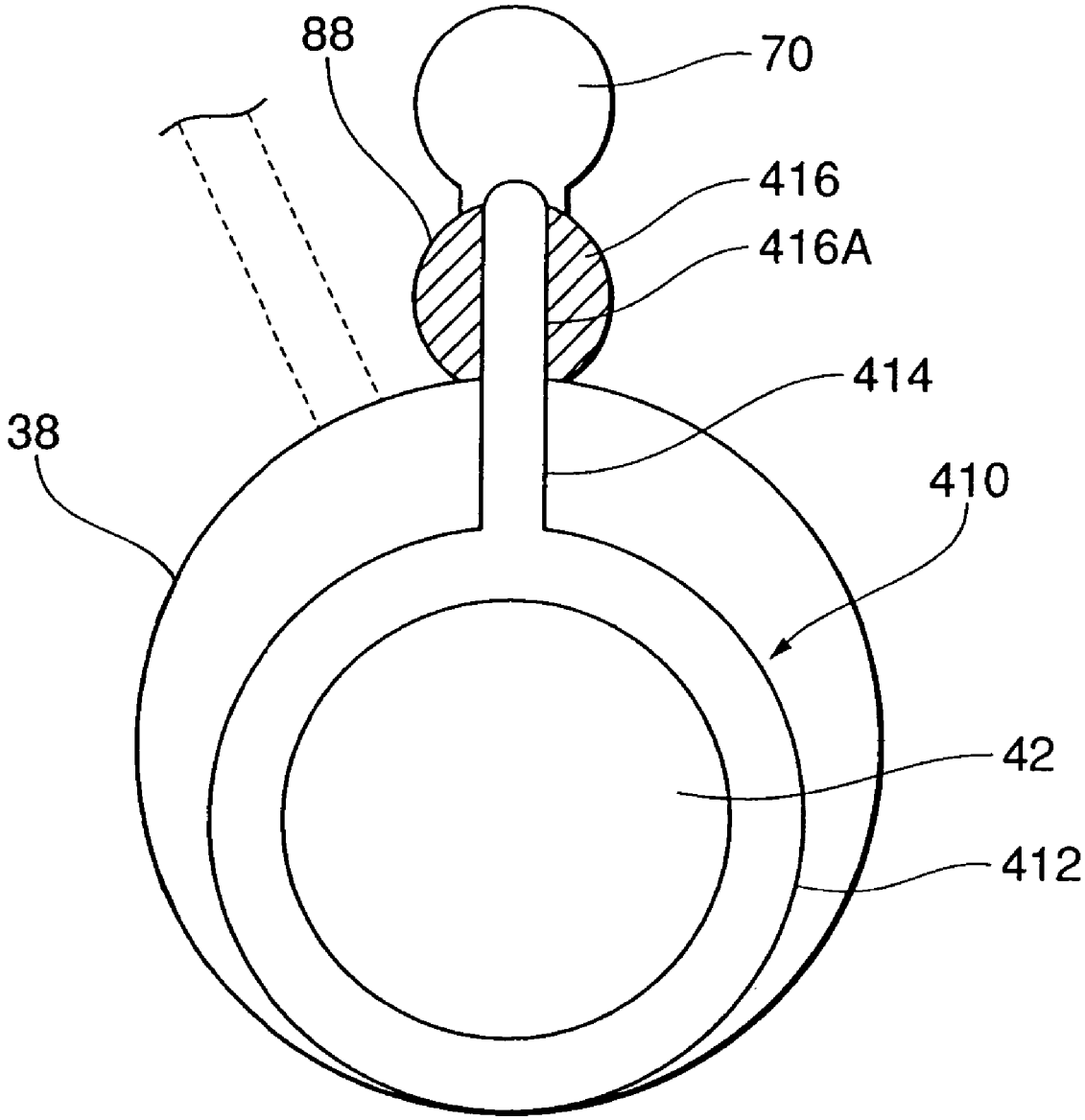
FIG. 19 is an expanded cross-sectional view for showing a swing piston portion of a second rotary compression element of the rotary compressor of FIG. 18.

The following will describe a multi-stage compression type rotary compressor according to an additional embodiment of the present invention with reference to FIGS. 18 and 19. FIG. 18 shows a vertical cross-sectional of a multi-stage compression type rotary compressor according to the present embodiment. It is to be noted that the same reference numerals in these figures as those in FIGS. 1–17 have the same or similar functions.

In FIG. 18, a reference numeral 10 indicates an internal medium-pressure, multi-stage compression type rotary compressor using carbon dioxide ($CO_2$) as a refrigerant which comprises the cylindrical sealed vessel 12 made of a steel plate and the rotary compression mechanism portion 18 which includes the electrical-power element 14 arranged and housed in an upper part of an internal space of the sealed vessel 12 and the first rotary compression element 32 (first stage) and the second rotary compression element 34 (second stage) which are arranged below this electrical-power element 14 to be driven by the rotary shaft 16 of the electrical-power element 14.

It is to be noted that in the rotary compressor 10 of the present embodiment, a displacement volume of the second rotary compression element 34 is set smaller than that of the first rotary compression element 32.

The sealed vessel 12 has its bottom used as an oil reservoir and is composed of the vessel body 12A which houses the electrical-power element 14 and the rotary compression mechanism portion 18 and the roughly cup-shaped end cap (lid) 12B which blocks an upper part opening of this vessel body 12A in such a configuration that at a top face of the end cap 12B is there attached the terminal 20 (wiring of which is omitted) which supplies power to the electrical-power element 14.

The electrical-power element 14 is composed of the stator 22 mounted annularly along an inner peripheral face of an upper-part space of the sealed vessel 12 and the rotor 24 disposed and inserted in the stator 22 with some gap set therebetween. This rotor 24 is fixed to the rotary shaft 16 which vertically extends centrally.

The stator 22 has the stack 26 formed by stacking donut-shaped electromagnetic steel plates and the stator coil 28 wound round teeth of the stack 26 by direct winding (concentrated winding). Furthermore, similar to the stator 22, the rotor 24 is also made of the stack 30 of electromagnetic steel plates and the permanent magnet MG inserted into the stack 30.

The intermediate partition plate 36 is sandwiched between the first rotary compression element 32 and the second rotary compression element 34. A combination of the first rotary compression element 32 and the second rotary compression element 34 is composed of the intermediate partition plate 36, the upper and lower cylinders 38 and 40 arranged above and below the intermediate partition plate 36 respectively, the upper and lower eccentric portions 42 and 44 which are positioned in the upper and lower cylinders 38 and 40 respectively and provided on the rotary shaft 16 with a phase difference of 180 degrees therebetween, and the upper-part support member 54 and the lower-part support member 56 given as a support member for blocking an upper-side opening face of the upper cylinder 38 and a lower-side opening face of the lower cylinder 40 respectively to serve also as a bearing for the rotary shaft 16.

The first rotary compression element 32 is provided with the lower roller 48 which eccentrically revolves as engaged to the lower eccentric portion 44 and the vane 52 which butts against this lower roller 48 to thereby divide an inside of the lower cylinder 40 into a low-pressure chamber side and a high-pressure chamber side. The cylinder 40 is provided with a guide groove for housing the vane 52 in such a manner that the vane 52 can slide therein and a spring 76 arranged outside this guide groove, so that this spring 76 butts against an outer end portion of the vane 52 to always urge the vane 52 on the roller 48. Furthermore, on a side of the sealed vessel 12 in a housing of this spring 76 is there provided a metallic plug 437 which serves to prevent fall-out of the spring 76.

The guide groove in the cylinder 40 communicates with an inside of the sealed vessel 12 on a side of the outer end of the vane 52, so that a later-described medium pressure in the sealed vessel 12 is applied as a back pressure for the vane 52 in configuration.

Furthermore, the upper cylinder 38 of the second rotary compression element 34 is provided therein with a swing piston 410, which is constituted of a roller portion 412 and a vane portion 414 (FIG. 19). The roller portion 412 is engaged to the upper eccentric portion 42 of the rotary shaft 16, so that as the upper eccentric portion 42 revolves in this roller portion 412 eccentrically, correspondingly the roller portion 412 itself moves eccentrically as butting against an inner face of the upper cylinder 38.

The vane portion 414, which projects from this roller portion 412 in a radial direction, enters a holding groove 416A in a later-described bush 416 and is held therein to thereby divide an inside of the upper cylinder 38 into a low-pressure chamber side and high-pressure chamber side in configuration (FIG. 19).

Furthermore, in the upper cylinder 38 is there formed the guide groove 70 extending from an inner circumference in a radial direction, at an inner end of which guide groove 70 is there formed as expanded a roughly cylindrical holding hole 88 vertically. Into this holding hole 88 the bush 416 described above is inserted to be held therein as rotating round a vertical axis as a center.

The holding groove 416A described above is formed through in this bush 416 along its center in a direction of a diameter of this bush 416 (radial direction of the upper cylinder 38), in such a configuration that the vane portion 414 of the swing piston 410 enters the guide groove 70 and passes through this holding groove 416A to be held in this holding groove 416A in such a manner that it can slide. In this condition, the vane portion 414 can move in the guide groove 70 and also, when the bush 416 itself rotates, the swing piston 410 itself is held in such a manner that it can slide and swing.

That is, the swing piston 410 has the roller portion 412 which eccentrically moves in the upper cylinder 38 in a condition where it is engaged to the upper eccentric portion 42 formed on the rotary shaft 16 of the electrical-power element 14 and is provided with the vane portion 414 which projects from this roller portion 412 in a radial direction to divide an inside of the upper cylinder 38 into a low-pressure chamber side and a high-pressure chamber side. In this configuration, as the upper eccentric portion 42 revolves eccentrically, the swing piston 410 swings in the upper cylinder 38. In the present embodiment, the guide groove 70 and the bush 416 constitute the holding portion of the present invention.

In this case, a spacing between the holding hole 88 and the bush 416 and that between the holding groove 416A and the vane portion 414 are dimensioned so that they may be sealed off from each other with oil therebetween respectively, to prevent a discharge pressure of the second rotary compression element 34 from being released. Such a construction eliminates a necessity of a spring on the second rotary compression element 34 for urging the vane 52 provided on the first rotary compression element 32 on the roller 48. If the second rotary compression element 34 is configured like the first rotary compression element 32, on the other hand, a back pressure is to be applied to the vane to urge it on the roller; a necessity of applying the back pressure to the vane, however, is rendered unnecessary because the second rotary compression element 34 is provided with the swing piston 410. This swing piston 410 is held by the bush 416 in such a manner that it can swing and slide, so that it is possible to smooth operations of the vane portion 414 owing to the swing piston 410, thus greatly improving performance of the rotary compressor 10.

The upper-part support member 54 and the lower-part support member 56, on the other hand, have the concave discharge-noise silencer chambers 62 and 64 formed therein, openings of which are blocked by respective covers. That is, the discharge-noise silencer chamber 62 is blocked by the upper cover 66 serving as a cover, while the discharge-noise silencer chamber 64 is blocked by the lower cover 68 serving as a cover.

It is to be noted that a portion of the upper cover 66 on a side of the electrical-power element 14 in the discharge-noise silencer chamber 64 and the sealed vessel 12 penetrates the upper and lower cylinders 38 and 40 and the intermediate partition 36 to communicate with an inside of the sealed vessel 12 through a communication path, not shown, which opens into the sealed vessel 12.

In this case also, as a refrigerant, carbon dioxide ($CO_2$) which is a natural refrigerant friendly to environments of the earth is used taking into account inflammability, toxicity, etc., while as a lubricant, such existing oil is used as mineral oil, alkyl-benzene oil, ether oil, or ester oil.

On a side face of the vessel body 12A of the sealed vessel 12, the sleeves 141, 142, 143, and 144 are fixed by welding at positions that correspond to the upper-side support member 54, the lower-part support member 56, the discharge-noise silencer chamber 62, and an upper side of the upper cover 66 (a lower end of the electrical-power element 14 roughly) respectively. The sleeves 141 and 142 are adjacent to each other vertically, while the sleeve 143 is roughly in a diagonal direction of the sleeve 141. Furthermore, the sleeve 144 is positioned as shifted by about 90 degrees with respect to the sleeve 141.

In the sleeve 141 is there inserted and connected one end of the refrigerant introduction pipe 92 for introducing a refrigerant gas to the upper cylinder 38, which one end communicates with a suction path of the upper cylinder 38. This refrigerant introduction pipe 92 passes through an upper part of the sealed vessel 12 up to the sleeve 144, while the other end is inserted and connected in the sleeve 144 so as to communicate with an inside of the sealed vessel 12.

In the sleeve 142, on the other hand, is there inserted and connected one end of the refrigerant introduction pipe 94 for introducing a refrigerant gas to the lower cylinder 40, which one end communicates with a suction path of the lower cylinder 40. The other end of this refrigerant introduction pipe 94 is connected to a lower end of an accumulator. Furthermore, in the sleeve 143 is there inserted and connected the refrigerant discharge pipe 96, one end of which communicates with the discharge-noise silencer chamber 62. It is to be noted that a reference numeral 147 indicates the bracket for holding the accumulator.

The following will describe operations with reference to this configuration. When the stator coil 28 of the electrical-power element 14 is electrified through the terminal 20 and a wiring line not shown, the electrical-power element 14 is actuated, thus causing the rotor 24 to revolve. By this revolution, a roller portion 112 of the swing piston 410 engaged to the upper eccentric portion 42 integrally provided with the rotary shaft 16 revolves in the upper cylinder 38 as described above, so that the roller 48 engaged to the lower eccentric portion 44 revolves eccentrically in the lower cylinder.

Accordingly, a low-pressure (first-stage suction pressure LP: 4 MPaG) refrigerant gas sucked into the low-pressure chamber side of the cylinder 40 from a suction port, not shown, through the refrigerant introduction pipe 94 and a suction path formed in the lower-part support member 56 is compressed by operations of the lower roller 48 and the vane 52 to have a medium pressure (MP1: 8 MPaG), passed through the high-pressure chamber side of the lower cylinder 40, a discharge port not shown, and the discharge-noise silencer chamber 64 formed in the lower-part support member 56, and is discharged into the sealed vessel 12 from the communication path described above. Thus, the sealed vessel 12 has the medium pressure (MP1) therein.

Then, the medium pressure refrigerant gas in the sealed vessel 12 exits it through the sleeve 144, passes through the refrigerant introduction pipe 92 and a suction path formed in the upper-part support member 54, and is sucked from a suction port, not shown, into the lower-pressure chamber side of the upper cylinder 38. The medium pressure refrigerant gas thus sucked undergoes second-stage compression through swinging of the swing piston 410 (the vane portion 414 and the roller portion 412) held slidingly in the holding groove 416A provided in the bush 416 held rotatably in the holding groove 88 in the upper cylinder 38 to thereby provide a high-temperature, high-pressure refrigerant gas (second-stage discharge pressure HP: 12 MPaG), which in turn passes from the high-pressure chamber side through a discharge port not shown, the discharge-noise silencer chamber 62 formed in the upper-part support member 54, and the refrigerant discharge pipe 96, and is discharged to an outside. This discharged refrigerant flows into the gas cooler 154. At this moment, the refrigerant has a raised temperature of about +100° C. and, therefore, such a high temperature, high pressure gas radiates heat to heat water in, for example, the hot-water storage tank to thus generate hot water having a temperature of about +90° C.

The refrigerant itself, on the other hand, is cooled at the gas cooler 154 and exits it. Then, the refrigerant is decompressed at the expansion valve 156, flows into the evaporator 157 to evaporate there, passes through the accumulator described above, and is sucked into the first rotary compression element 32 through the refrigerant introduction pipe 94, which cycle is repeated.

Thus, the present embodiment according to the present embodiment comprises the upper cylinder 38 which constitutes the second rotary compression element 34 and the swing piston 410 which has the roller portion 412 which is engaged to the upper eccentric portion 42 formed on the rotary shaft 16 of the electrical-power element 14 to thereby move in the upper cylinder 38 eccentrically, in which on the swing piston 410 is there formed the vane portion 414 which projects from the roller portion 412 in a radial direction to divide an inside of the upper cylinder 38 into a low-pressure chamber side and a high-pressure chamber side in such a configuration that the vane portion 414 of the swing piston 410 is held at the upper cylinder 38 in such a manner that the vane portion 414 can slide and swing, so that a conventional construction to apply a back pressure to the vane and a spring to urge the vane on the roller are rendered unnecessary. Especially in an internal medium-pressure, multi-stage compression type rotary compressor according to the present embodiment, it is unnecessary to provide a construction to apply a discharge pressure of the second rotary compression element 34 to the vane as a back pressure, thus simplifying a construction of the rotary compressor 10 and greatly reducing productions costs.

Although the present embodiment has provided the swing piston 410 on the second rotary compression element 34, the present invention is not limited thereto; for example, the swing piston 410 may be provided on the first rotary compression element 32 instead. By providing the swing piston 410 only to the second rotary compression element 34 as in the case of the present embodiment, costs of parts can be reduced. Furthermore, although the present embodiment has applied the present invention to an internal medium-pressure, multi-stage compression type rotary compressor, the present invention is not limited thereto; for example, the present invention may be applied to an ordinary single-cylinder type roller.

As detailed above, by the present invention, in a rotary compressor for compressing a $CO_2$ refrigerant according to the present embodiment which comprises an electrical-power element and a rotary compression element driven by this electrical-power element in a sealed vessel, there are provided a cylinder constituting the rotary compression element, a swing piston having a roller portion which is engaged to an eccentric portion formed on a rotary shaft of the electrical-power element to eccentrically moves in the cylinder, a vane portion formed on this swing piston in such a manner as to project from the roller portion in a radial direction to thereby divide an inside of the cylinder into a low-pressure chamber side and a high-pressure chamber side, and a holding portion provided on the cylinder to hold the vane portion of the swing piston in such a manner that the vane portion can slide and swing, so that as the eccentric portion of the rotary shaft revolves eccentrically, the swing piston correspondingly swings and slides round the holding portion as a center and, therefore, the vane portion thereof always divides the inside of the cylinder into the low-pressure chamber side and the high-pressure chamber side.

Accordingly, it is possible to eliminate a necessity of conventionally providing a spring for urging the vane on a roller side, a back pressure chamber, or a structure for applying a back pressure to the back pressure chamber, thus simplifying a construction of the rotary compressor and reducing costs in production.

Furthermore, in a rotary compressor comprising an electrical-power element and first and second rotary compression elements driven by this electrical-power element in a sealed vessel in such a configuration that a $CO_2$ refrigerant gas compressed at the first rotary compression element is discharged into the sealed vessel and this discharged medium pressure gas is compressed at the second rotary compression element, there are provided a cylinder constituting the second rotary compression element, a swing piston having a roller portion which is engaged to an eccentric portion formed on a rotary shaft of the electrical-power element to eccentrically move in the cylinder, a vane portion which is formed on this swing piston in such a manner as to project from the roller portion in a radial direction to thereby divide an inside of the cylinder into a low-pressure chamber side and a high-pressure chamber side, and a holding portion which is provided on the cylinder to hold the vane portion of the swing piston in such a manner that the vane can slide and swing, so that similarly, as the eccentric portion of the rotary shaft revolves eccentrically, the swing piston correspondingly swings and slides round the holding portion as a center and, therefore, the vane portion thereof always divides the inside of the cylinder of the second rotary compression element into the low-pressure chamber side and the high-pressure chamber side.

Accordingly, it is possible to eliminate a necessity of conventionally providing a spring for urging the vane on the roller side, a back pressure chamber, or a structure for applying a back pressure to the back pressure chamber. Especially in a so-called multi-stage compression type rotary compressor in which a medium pressure develops in a sealed vessel as in the case of the present invention, a structure for applying a back pressure is complicated; by using a swing piston, however, it is possible to simplify the structure remarkably and reduce production costs.

Furthermore, the holding portion is constituted of a guide groove which is formed in the cylinder and which the vane portion of the swing piston can enter movably and a bush which is provided rotatably at this guide groove to slidingly support the vane portion, so that it is possible to smooth swinging and sliding operations of the swing piston. Accordingly, it is possible to greatly improve performance and reliability of the rotary compressor.

Figure 20:
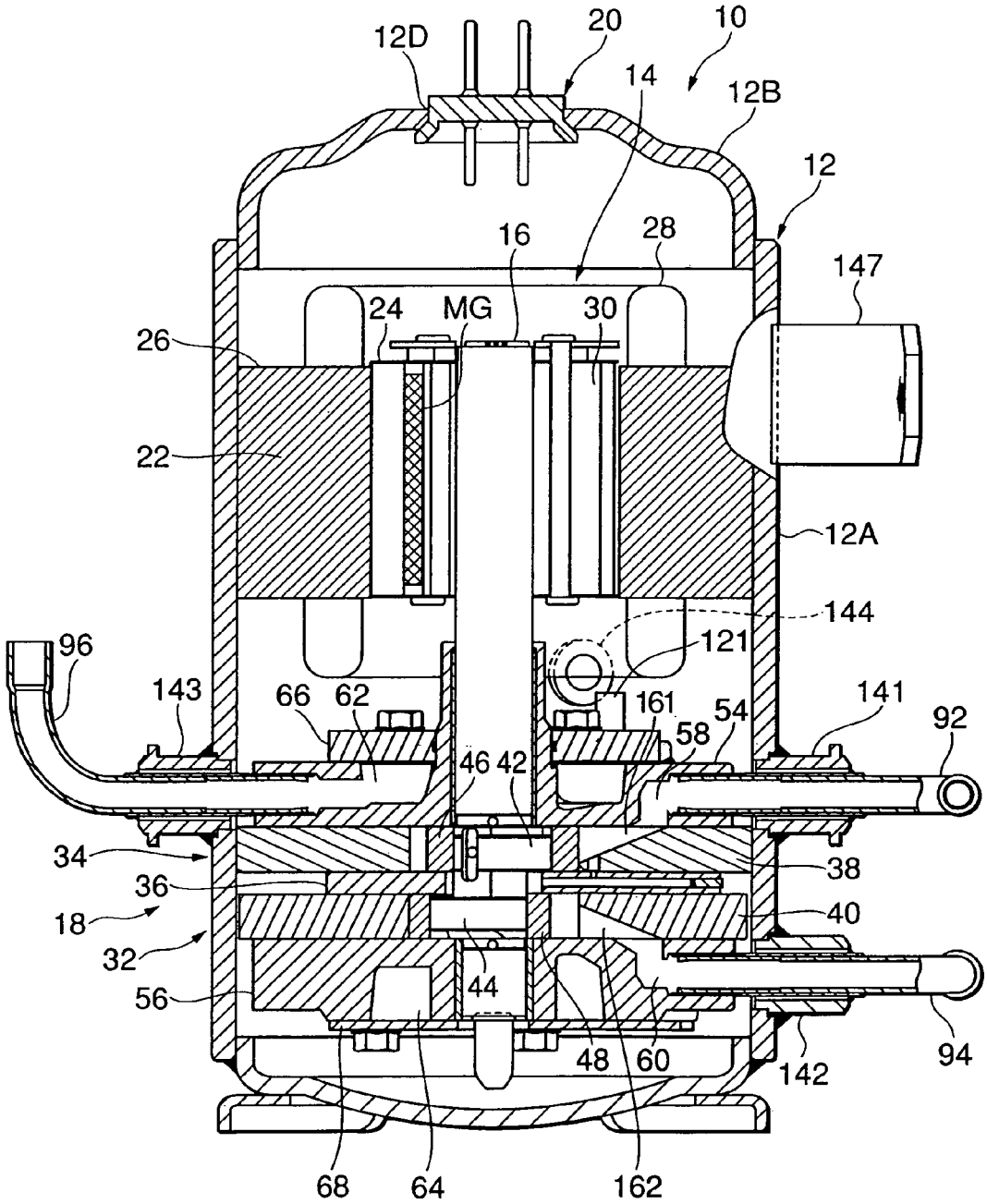
FIG. 20 is a vertical cross-sectional view for showing a multi-stage compression type rotary compressor according to an additional embodiment of the present invention applied to a defroster for a refrigerant circuit.
Figure 21:
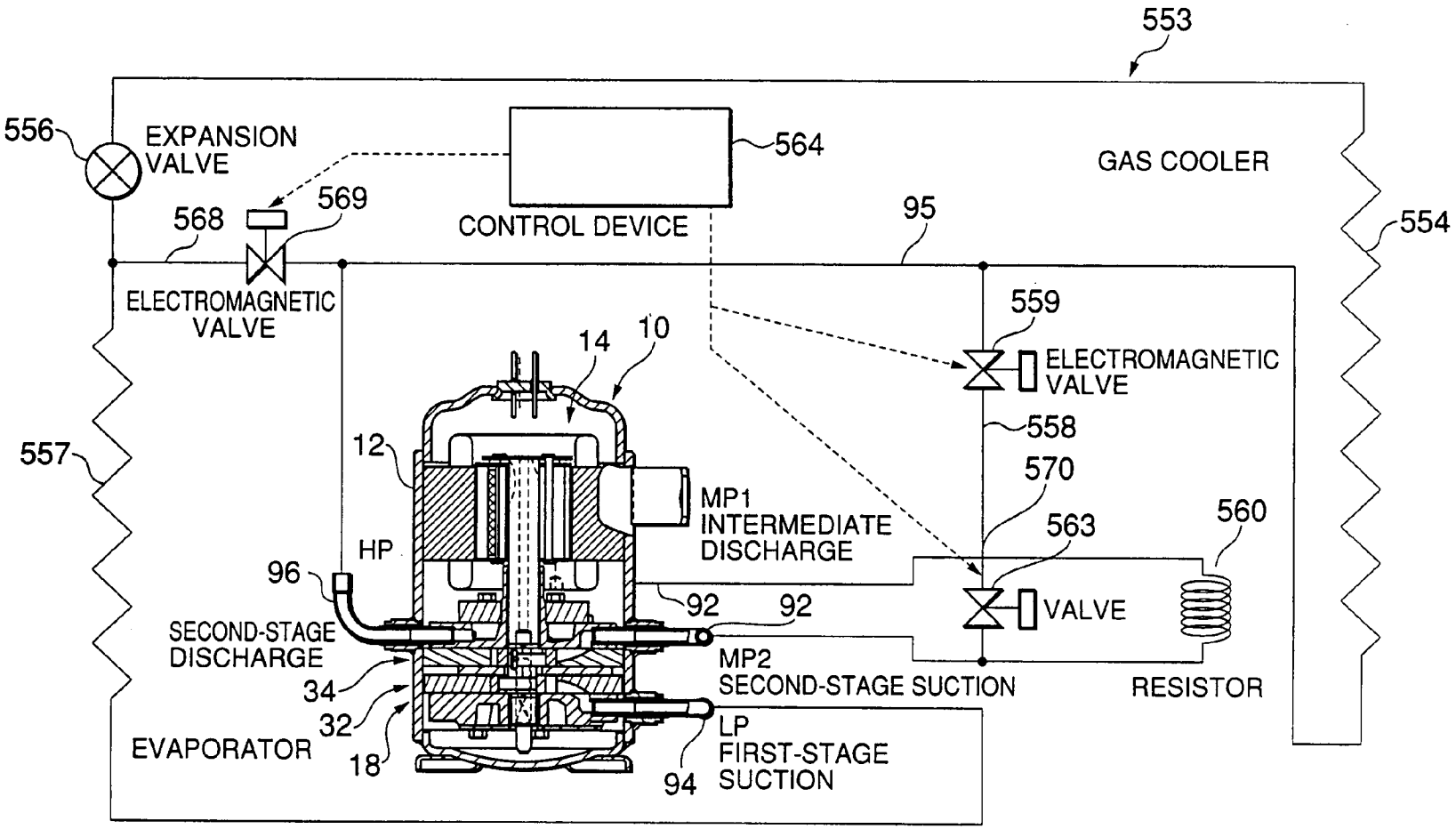
FIG. 21 is a diagram for showing a refrigerant circuit of a hot-water supply apparatus to which the rotary compressor of FIG. 20 is applied.

The following will describe a defroster for a refrigerant circuit according to another additional embodiment of the present invention with reference to FIGS. 21 and 21. FIG. 20 shows a vertical cross-sectional of a multi-stage compression type rotary compressor used in this case. It is to be noted that the same reference numerals in these figures as those in FIGS. 1–19 indicate the same or similar functions.

In FIG. 20, a reference numeral 10 indicates an internal medium-pressure, multi-stage compression type rotary compressor using carbon dioxide ($CO_2$) as a refrigerant which comprises the cylindrical sealed vessel 12 made of a steel plate and the rotary compression mechanism portion 18 which includes the electrical-power element 14 arranged and housed in an upper part of an internal space of the sealed vessel 12 and the first rotary compression element 32 (first stage) and the second rotary compression element 34 (second stage) which are arranged below the electrical-power element 14 to be driven by the rotary shaft 16 of the electrical-power element 14.

The sealed vessel 12 has its bottom used as an oil reservoir and is composed of the vessel body 12A which houses the electrical-power element 14 and the rotary compression mechanism portion 18 and the roughly cup-shaped end cap (lid) 12B which blocks an upper part opening of the vessel body 12A. Furthermore., the end cap 12B has the circular attachment hole 12D formed therein at a center of its top face, in which attachment hole 12D the terminal 20 (wiring of which is omitted) is fixed by welding which supplies power to the electrical-power element 14.

The electrical-power element 14 is composed of the stator 22 mounted annularly along an inner peripheral face of an upper-part space of the sealed vessel 12 and the rotor 24 disposed and inserted in the stator 22 with some gap therebetween in such a configuration that to this rotor 24 is there fixed the rotary shaft 16 which vertically extends centrally.

The stator 22 has the stack 26 formed by stacking donut-shaped electromagnetic steel plates and the stator coil 28 wound round teeth of the stack 26 by direct winding (concentrated winding). Furthermore, the rotor 24 is constituted of the stack 30 of electromagnetic steel plates and the permanent magnet MG inserted into the stack 30.

The intermediate partition plate 36 is sandwiched between the first rotary compression element 32 and the second rotary compression element 34. That is, a combination of the first rotary compression element 32 and the second rotary compression element 34 is composed of the intermediate partition plate 36, the upper and lower cylinders 38 and 40 arranged above and below the intermediate partition plate 36 respectively, the upper and lower rollers 46 and 48 which are fitted to the upper and lower eccentric portions 42 and 44 provided on the rotary shaft 16 with a phase difference of 180 degrees therebetween so as to eccentrically revolve within the upper and lower cylinders 38 and 40 respectively, upper and lower vanes 50 and 52, not shown, which butt against the upper and lower rollers to divide an inside of the respective upper and lower cylinders 38 and 40 into a low-pressure chamber side and a high-pressure chamber side, and the upper-part support member 54 and the lower-part support member 56 given as a support member for blocking an upper-side opening face of the upper cylinder 38 and a lower-side opening face of the lower cylinder 40 respectively to serve also as a bearing for the rotary shaft 16.

Furthermore, a combination of the upper-part support member 54 and the lower-part support member 56 is provided therein with the suction paths 58 and 60 communicating with insides of the upper and lower cylinders 38 and 40 through the suction ports 161 and 162 respectively and the discharge-noise silencer chambers 62 and 64 which are formed by concaving a surface partially and then blocking resultant concavities by the upper cover 66 and the lower cover 68 respectively.

It is to be noted that the discharge-noise silencer chamber 64 communicates with an inside of the sealed vessel 12 through a communication path, not shown, which penetrates the upper and lower cylinders 38 and 40 and the intermediate partition plate 36 in such a configuration that at an upper end of the communication path, an intermediate discharge pipe 121 is provided as erected, through which a medium pressure refrigerant compressed at the first rotary compression element 32 is discharged into the sealed vessel 12.

Furthermore, the upper cover 66 defines the discharge-noise silencer chamber 62 communicating with an inside of the upper cylinder 38 of the second rotary compression element 34, above which upper cover 66 is there provided the electrical-power element 14 with a predetermined spacing therebetween.

In this case also, as a refrigerant, carbon dioxide ($CO_2$) which is a natural refrigerant friendly to environments, of the earth is used taking into account inflammability, toxicity, etc., while as a lubricant, such existing oil is used as mineral oil, alkyl-benzene oil, ether oil, ester oil, or poly-alkyl glycol (PAG).

Onto a side face of the vessel body 12A of the sealed vessel 12, sleeves 141, 142, 143, and 144 are fixed by welding at positions that correspond to the suction paths 58 and 60 of the respective upper-part support member 54 and the lower-part support member 56, the discharge-noise silencer chamber 62, and an upper side of the upper cover 66 (a lower part of the electrical-power element 14 roughly) respectively. The sleeves 141 and 142 are adjacent to each other vertically, while the sleeve 143 is roughly in a diagonal direction of the sleeve 141. Furthermore, the sleeve 144 is positioned as shifted by about 90 degrees with respect to the sleeve 141.

In the sleeve 141 is there inserted and connected one end of a refrigerant introduction pipe 92 serving as a refrigerant path for introducing a refrigerant gas to the upper cylinder 38, which one end communicates with the suction path 58 of the upper cylinder 38. This refrigerant introduction pipe 92 passes through an upper part of the sealed vessel 12 up to the sleeve 144, while the other end is inserted and connected in the sleeve 144 to communicate with the inside of the sealed vessel 12.

In the sleeve 142, on the other hand, is there inserted and connected one end of a refrigerant introduction pipe 94 for introducing a refrigerant gas to the lower cylinder 40, which one end communicates with the suction path 60 of the lower cylinder 40. The other end of this refrigerant introduction pipe 94 is connected to a lower end of an accumulator not shown. Furthermore, in the sleeve 143 is there inserted and connected the refrigerant discharge pipe 96, one end of which communicates with the discharge-noise silencer chamber 62.

This accumulator is a tank for separating an sucked refrigerant into vapor and liquid and attached via a bracket thereof, not shown, to the bracket 147 of a sealed vessel side welded and fixed to an upper-part side face of the vessel body 12A of the sealed vessel 12.

Next, FIG. 21 shows a refrigerant circuit of a hot-water supply apparatus 553 to which the present embodiment of the present invention is applied, in which the multi-stage compression type rotary compressor 10 constitutes part of a refrigerant circuit of the hot-water supply apparatus 553 shown in FIG. 21. That is, the refrigerant discharge pipe 96 of the multi-stage compression type rotary compressor 10 is connected to an inlet of a gas cooler 154, which is provided to a hot-water storage tank, not shown, of the hot-water supply apparatus 553 in order to heat water and generate hot water. The pipe exits the gas cooler 554 and passes through an expansion valve 556 serving as a decompression device up to an inlet of an evaporator 557, an outlet of which is connected via the accumulator described above (not shown) to the refrigerant introduction pipe 94.

Furthermore, a defrosting pipe 558 constituting a defrosting circuit branches from somewhere along the refrigerant introduction pipe (refrigerant path) 92 for introducing a refrigerant in the sealed vessel 12 into the second rotary compression element 34 and is connected through an electromagnetic valve 559 constituting a first flow-path control device to the refrigerant discharge pipe 96 extending to the inlet of the gas cooler 554.

Another defrosting pipe 568 is provided to communicate, to each other the refrigerant discharge pipe 96 and a pipe interconnecting the expansion valve 556 and the evaporator 557, to which defrosting pipe 568 is there equipped another electromagnetic valve 569 constituting the first flow-path control device. Furthermore, to the refrigerant introduction pipe 92 on a downstream side of a branching point 570 of the defrosting pipe 558 are there provided a capillary tube 560 serving as a second decompression device and an electromagnetic valve 563 connected in parallel with this capillary tube 560 to serve as a second flow-path control device.

In this configuration, the electromagnetic valves 559, 569, and 563 are controlled in opening and closing by the control device 564. The electromagnetic valve 563 is opened by the control device 563 in ordinary defrosting operation. Accordingly, during defrosting operation, a refrigerant gas supplied to the second rotary compression element 34 is decompressed through the capillary tube 560 (decompression device) provided to the refrigerant introduction pipe 92 (refrigerant path) and then supplied to the second rotary-compression element 34. In such a way, as described later, a pressure difference develops between an suction side and a discharge side of the second rotary compression element 34 to thereby prevent breakaway of the vane, thus avoiding unstable operation during defrosting for improvements in reliability.

The following will describe operations with reference to this configuration. It is to be noted that the control device 564 closes the electromagnetic valves 559 and 569 and opens the electromagnetic valve 563 in heating operation as described above. When the stator coil 28 of the electrical-power element 14 is electrified through the terminal 20 and a wiring line not shown, the electrical-power element 14 is actuated, thus causing the rotor 24 to revolve. By this revolution, the rollers 46 and 48 fitted to the upper and lower eccentric portions 42 and 44 provided integrally with the rotary shaft 16 revolve eccentrically in the upper and lower cylinders 38 and 40 respectively.

Accordingly, a low-pressure (first-stage suction pressure LP: 4 MPaG) refrigerant sucked into the low-pressure chamber side of the cylinder 40 from a suction port 562 through the refrigerant introduction pipe 94 and the suction path 60 formed in the lower-part support member 56 is compressed by operations of the lower roller 48 and the vane to have a medium pressure (MP1: 8 MPaG), passed through the high-pressure chamber side of the lower cylinder 40, a discharge port not shown, and the discharge-noise silencer chamber 64 formed in the lower-part support member 56, and is discharged into the sealed vessel 12 from a communication path not shown. Thus, the sealed vessel 12 has the medium pressure (MP1) therein.

Then, the medium pressure refrigerant gas in the sealed vessel 12 exits it through the refrigerant introduction pipe 92 of the sleeve 144 (where an intermediate discharge pressure is MP1 described above), passes through the electromagnetic valve 563 connected in parallel with the capillary tube 560 of this refrigerant introduction pipe 92 and the suction path 58 formed in the upper-part support member 54, and is sucked into the low-pressure chamber side of the upper cylinder 38 from the suction port 161 (second-stage suction). The medium pressure refrigerant gas thus sucked undergoes second-stage compression through operations of the roller 46 and a vane not shown to thereby provide a high-temperature, high-pressure refrigerant gas (second-stage discharge pressure HP: 12 MPaG), which in turn passes from the high-pressure chamber side through a discharge port not shown, the discharge-noise silencer chamber 62 formed in the upper-part support member 54, and the refrigerant discharge pipe 96, and flows into the gas cooler 554. At this moment, the refrigerant has a raised temperature of about +100° C. and, therefore, such a high temperature, high pressure gas radiates heat through the gas cooler 554 to heat water in the hot-water storage tank to thus generate hot water having a temperature of about +90° C.

The refrigerant itself, on the other hand, is cooled at the gas cooler 554 and exits it. Then, the refrigerant is decompressed at the expansion valve 556, flows into the evaporator 557 to evaporate there (while absorbing heat from surroundings), passes through the accumulator, and is sucked into the first rotary compression element 32 through the refrigerant introduction pipe 94, which cycle is repeated.

Especially in a low outside-air temperature environment, such heating operation causes the evaporator 557 to be frosted. Therefore, periodically or according to an arbitrary instruction for operation, the control device 564 opens the electromagnetic valves 559 and 569 and closes the electromagnetic valve 563 and, furthermore, opens the expansion valve 556 fully to thereby defrost the evaporator 557. When the electromagnetic valves 559 and 569 are opened, a refrigerant gas discharged from the first rotary compression element 32 into the sealed vessel 12 flows either through the refrigerant introduction pipe 92, the defrosting pipe 558, the refrigerant discharge pipe 96, and the defrosting pipe 568 toward a downstream side of the expansion valve 556 or through the gas cooler 554 and the expansion valve 556 (opened fully), in both cases of which the refrigerant directly flows into the evaporator 557 without being decompressed.

Furthermore, a refrigerant gas discharged from the second rotary compression element 34 passes through the refrigerant discharge pipe 96 and the defrosting pipe 568 to flow toward the downstream side of the expansion valve 556 into the evaporator 557 directly without being decompressed. When such a high-temperature, high-pressure refrigerant gas flows into the evaporator 557, it is heated and defrosted as melting.

In this case, when the electromagnetic valves 559 and 569 are opened, a discharge side and a suction side of the second rotary compression element 34 communicate with each other through the refrigerant discharge pipe 96, the defrosting pipe 558, and the refrigerant introduction pipe 92 and so have the same pressure naturally; by the present invention, however, the electromagnetic valve 563 is closed in defrosting operation, so that the capillary tube 560 is interposed between the suction side (side of the refrigerant introduction pipe 92) and the discharge side (side of the refrigerant discharge pipe 96) of the second rotary compression element 34 in configuration.

Accordingly, a refrigerant gas to be compressed at the first rotary compression element 32, discharge into the sealed vessel 12, and supplied to the second rotary compression element 34 through the refrigerant introduction pipe 92 is actually supplied through this capillary tube 560 to the second rotary compression element 34. That is, since the refrigerant gas is decompressed at the capillary tube 560, a pressure difference occurs between a suction side and a discharge side of the second rotary compression element 34 to thereby prevent breakaway of the vane in order to avoid unstable defrosting operation, thus improving reliability.

Such defrosting operation ends, for example, when the evaporator 557 reaches a predetermined defrosting temperature or time. When defrosting ends, the control device 564 closes the electromagnetic valves 559 and 569 and opens the electromagnetic valve 563 to return to ordinary heating operation.

Although the present embodiment has used the multi-stage compression type rotary compressor 10 in a refrigerant circuit of the hot-water supply apparatus 553, the present invention is not limited thereto; for example, it may well be applied for warming of a room. Furthermore, although the present embodiment has employed an internal medium-pressure multi-stage compression type rotary compressor, the present invention is not limited thereto; for example, it is applicable also to such a configuration that a refrigerant discharged from the first rotary compression element 32 is supplied through the refrigerant introduction pipe 92 to the second rotary compression element 34 without passing it through the sealed vessel 12.

As detailed above, according to the present embodiment of the present invention, in a refrigerant circuit comprising a multi-stage compression type rotary compressor including an electrical-power element and first and second rotary compression elements driven by this electrical-power element in a sealed vessel in such a configuration that a refrigerant compressed at the first rotary compression element is then compressed at the second rotary compression element, a gas cooler into which the refrigerant discharged from the second rotary compression element of this multi-stage compression type rotary compressor flows, a first decompression device connected to an outlet side of this gas cooler, and an evaporator connected to an outlet side of this first decompression device in such a configuration that the refrigerant discharged from this evaporator is compressed at the first rotary compression element, there are provided a defrosting circuit for supplying the refrigerant discharged from the first and second rotary compression elements to the evaporator without decompressing it, a first flow-path control device which controls flow of the refrigerant through this defrosting circuit, a second decompression device provided along a refrigerant path for supplying the second rotary compression element with the refrigerant discharged from the first rotary compression element, and a second flow-path control device which controls whether the refrigerant is allowed to flow through this second decompression device or the refrigerant is allowed to bypass it, wherein when the refrigerant is controlled by the first flow-path control device to flow to the defrosting circuit, this second flow-path control device controls the refrigerant to flow to the second decompression device, so that during defrosting operation of the evaporator, the refrigerant discharged from the first and second rotary compression elements is supplied to the evaporator without being decompressed, thus avoiding reversion in pressure level relationship at the second rotary compression element.

In particular, by the present invention, during such defrosting operation, a refrigerant is controlled to be supplied to the second rotary compression element through the decompression device provided along the refrigerant path, so that a predetermined pressure difference is established between suction and discharge sides of the second rotary compression element.

Accordingly, the second rotary compression element becomes stable in operation, thus improving reliability. In particular, remarkable effects are obtained in the case of a refrigerant circuit using a $CO_2$ gas as a refrigerant.

What is claimed is:

1. A rotary compressor comprising:

an electrical-power element;

a sealed vessel; and first and second rotary compression elements driven by the electrical-power element in the sealed vessel and disposed in a configuration such that gas compressed at the first rotary compression element is discharged into the sealed vessel and this discharged medium pressure gas is compressed by the second rotary compression element, the rotary compressor further comprising;

a cylinder constituting the second rotary compression element, a swing piston having a roller portion engaged to an eccentric portion formed on a rotary shaft of the electrical-power element to eccentrically move in the cylinder, a vane portion formed on the swing piston to project from the roller portion in a radial direction to divide an inside of the cylinder into a low-pressure chamber side and a high-pressure chamber side, and a holding portion on the cylinder to which the vane portion of the swing piston is mounted and which permits slideable and swinging movement of the vane.

2. The rotary compressor according to claim 1, wherein the holding portion comprises a guide groove which is formed in the cylinder and into which the vane portion of the swing piston can enter movably, and a bush which is provided rotatably at the guide groove to slidingly support the vane portion.

3. The rotary compressor according to claim 1 wherein the $CO_2$ is the gas that is compressed.

* * * * *